United States Patent [19]

Yoshizawa et al.

[11] Patent Number: 4,992,805

[45] Date of Patent: Feb. 12, 1991

[54] IMAGE RECORDING APPARATUS

[75] Inventors: Atsutomo Yoshizawa; Hiroshi Sugiyama, both of Tokyo; Nobuyuki Watanabe, Yokohama, all of Japan

[73] Assignee: Canon Kabushiki Kaisha, Tokyo, Japan

[21] Appl. No.: 492,295

[22] Filed: Feb. 28, 1990

Related U.S. Application Data

[63] Continuation of Ser. No. 366,211, Jun. 15, 1989, abandoned, which is a continuation of Ser. No. 230,442, Aug. 10, 1988, abandoned.

[30] Foreign Application Priority Data

| | | | |
|---|---|---|---|
| Aug. 14, 1987 | [JP] | Japan | 62-201819 |
| Aug. 14, 1987 | [JP] | Japan | 62-201820 |
| Aug. 14, 1987 | [JP] | Japan | 62-201821 |
| Aug. 14, 1987 | [JP] | Japan | 62-201822 |
| Aug. 14, 1987 | [JP] | Japan | 62-201824 |

[51] Int. Cl.[5] ..... B41V 2/01; B41V 2/165; B41V 2/175

[52] U.S. Cl. ..... 346/134; 346/136; 346/140 R; 400/605; 400/642

[58] Field of Search ..... 346/134, 136, 140; 400/595, 600, 605, 613.1, 619, 624, 642, 126

[56] References Cited

U.S. PATENT DOCUMENTS

| | | | |
|---|---|---|---|
| 4,651,173 | 3/1987 | Ozawa | 346/136 |
| 4,789,258 | 12/1988 | Gomoll | 400/605 |

FOREIGN PATENT DOCUMENTS

| | | |
|---|---|---|
| 63-114681 | 5/1988 | Japan . |

*Primary Examiner*—Joseph W. Hartary

*Attorney, Agent, or Firm*—Fitzpatrick, Cella, Harper & Scinto

[57] ABSTRACT

An apparatus for recording an image on a recording medium comprises a platen, a recording head arranged to oppose said platen for recording the image on the recording medium, first conveying member arranged upstream of the platen along a conveying direction of the recording medium for conveying the recording medium, second conveying member arranged downstream of the platen along the conveying direction of the recording medium for conveying the recording medium; guide member for guiding the recording medium when the recording medium is fed from the first conveying member to the second conveying member, and driving motor for causing the guide member to set at an operative position where the member guides the recording medium and a retracted position where the guiding member is retracted from the operative position.

17 Claims, 20 Drawing Sheets

IMAGE RECORDING APPARATUS

This application is a continuation of application Ser. No. 07/366,211 filed June 15, 1989, now abandoned, which was a continuation of application Ser. No. 07/230,442, filed Aug. 10, 1988, now abandoned.

BACKGROUND OF THE INVENTION

1. Field of the Invention

The present invention relates to an image recording apparatus for recording an image on a recording medium and, more particularly, to an image recording apparatus capable of improving the quality of a recorded image.

2. Related Background Art

In a conventional recording apparatus for recording an image on a recording medium while a recording head opposes the recording medium, a platen is arranged at the opposing position to guide the surface of the recording medium. A conveying path is formed to supply the recording medium toward the platen and separate the recording medium from the platen after recording. Conveying members such as rollers are disposed at the upstream and downstream positions of the conveying path with respect to the platen so as to hold the recording medium and to define the conveying path. At the same time, the conveying members are operated to bring the recording medium into tight contact with the platen.

As described above, the recording medium is guided along the conveying path prior to recording, and the leading end of the recording medium is held by the downstream conveying member with respect to the platen.

When the recording medium is set at the recording position, simple conveyance does not allow smooth holding of the leading end of the recording medium with the downstream conveying member, thus causing so-called paper jam. More specifically, the leading end of the recording medium which has passed the upstream conveying member is deviated from the conveying path due to warping of the recording medium itself and its weight and abuts against other members. Paper jam particularly occurs when a large recording medium such as an A2 or A1 sheet is used or a roll of paper is used as the recording medium.

In order to eliminate the above disadvantage, a proper member may be disposed near the platen during setting of the recording medium to smoothly guide the leading end of the recording medium. However, this member is preferably removed to a position so as not to interfere with the operation of the recording head during recording.

SUMMARY OF THE INVENTION

It is an object of the present invention to provide an image recording apparatus capable of properly guiding a recording medium to a recording position.

It is another object of the present invention to provide an image recording medium capable of accurately guiding the recording medium to the recording position and improving the quality of a recorded image.

It is still another object of the present invention to provide an image recording apparatus capable of reducing a possibility of occurrence of so-called paper jam.

It is still another object of the present invention to provide an image recording apparatus wherein movement of the recording head for forming an image is not interfered with.

It is still another object of the present invention to provide an image recording apparatus capable of smoothly setting the recording medium (guiding the recording medium to the image recording position) and preventing interference with the recording head operation during recording regardless of types or states of recording mediums by properly arranging a guide member and a mechanism for moving the guide member.

It is still another object of the present invention to provide an ink-jet recording apparatus wherein drawbacks caused by slippage and errors can be eliminated, and degradation of quality of the recorded image and disconnections of supply pipes do not occur when a recording head and an ink tank are mounted on corresponding carriages and driven by separate driving sources.

It is still another object of the present invention to provide an ink-jet recording apparatus wherein a recording head and an ink storage means are mounted on corresponding moving means and are moved in a scanning direction, thereby using a low-output, high-precision means for driving the recording head.

DETAILED DESCRIPTION OF THE PREFERRED EMBODIMENTS

A preferred embodiment of the present invention will be described in detail with reference to the accompanying drawings.

Outer Appearance

Figure 1:
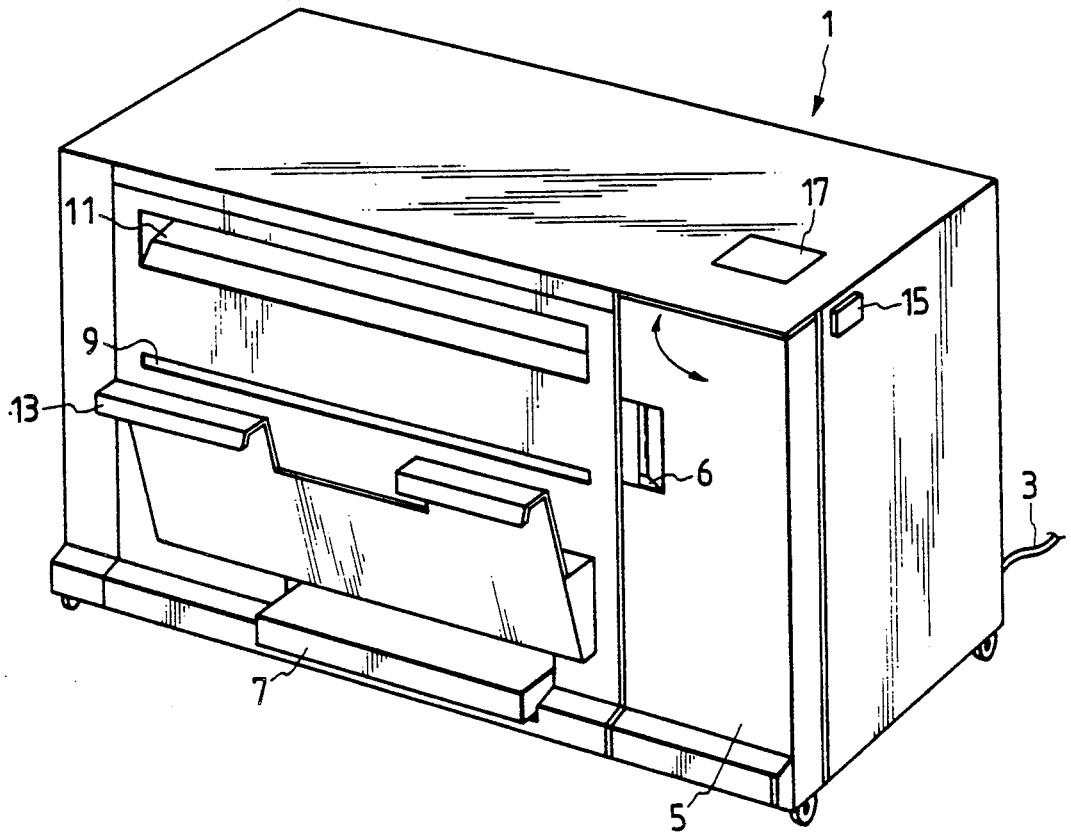
FIG. 1 is a perspective view showing an outer appearance of an ink-jet recording apparatus according to an embodiment of the present invention.

FIG. 1 shows an outer appearance of an ink-jet recording apparatus according to an embodiment of the present invention. In the ink-jet recording apparatus, a main unit 1 is connected to a host device 1000 (FIG. 29) through a transmission cable 3 to receive image data or the like to output an image according to ink-jet recording. A door 5 is mounted on the right side of the front surface of the main unit 1. The door 5 is opened to replenish an ink tank with an ink. In this case, an operator holds a handle 6 to pivot the door 5 in one of the directions indicated by a double-headed arrow to expose the inside of the main unit 1.

Sheets as recording media are stacked in a cassette 7. A manual insertion port 9 is formed to manually feed the recording medium. An exhaust port 11 is formed at the upper portion of the front surface of the main unit 1. A recorded medium or the like is exhausted from the exhaust port 11 and is stacked in an exhaust tray 13.

A voltage ON/OFF switch 15 is arranged on the upper portion of the right side wall to enable/disable the power source of the main unit 1. An operation panel 17 is arranged on the front side of the upper surface of the main unit 1. The operation panel 17 includes an ON line switch for allowing the main unit to communicate with the host device, a command means such as switches for selecting a recording medium and a feed mode thereof, and a display means for displaying an ON/OFF line state, and a selected mode.

General Description of Internal Arrangement

Figure 2:
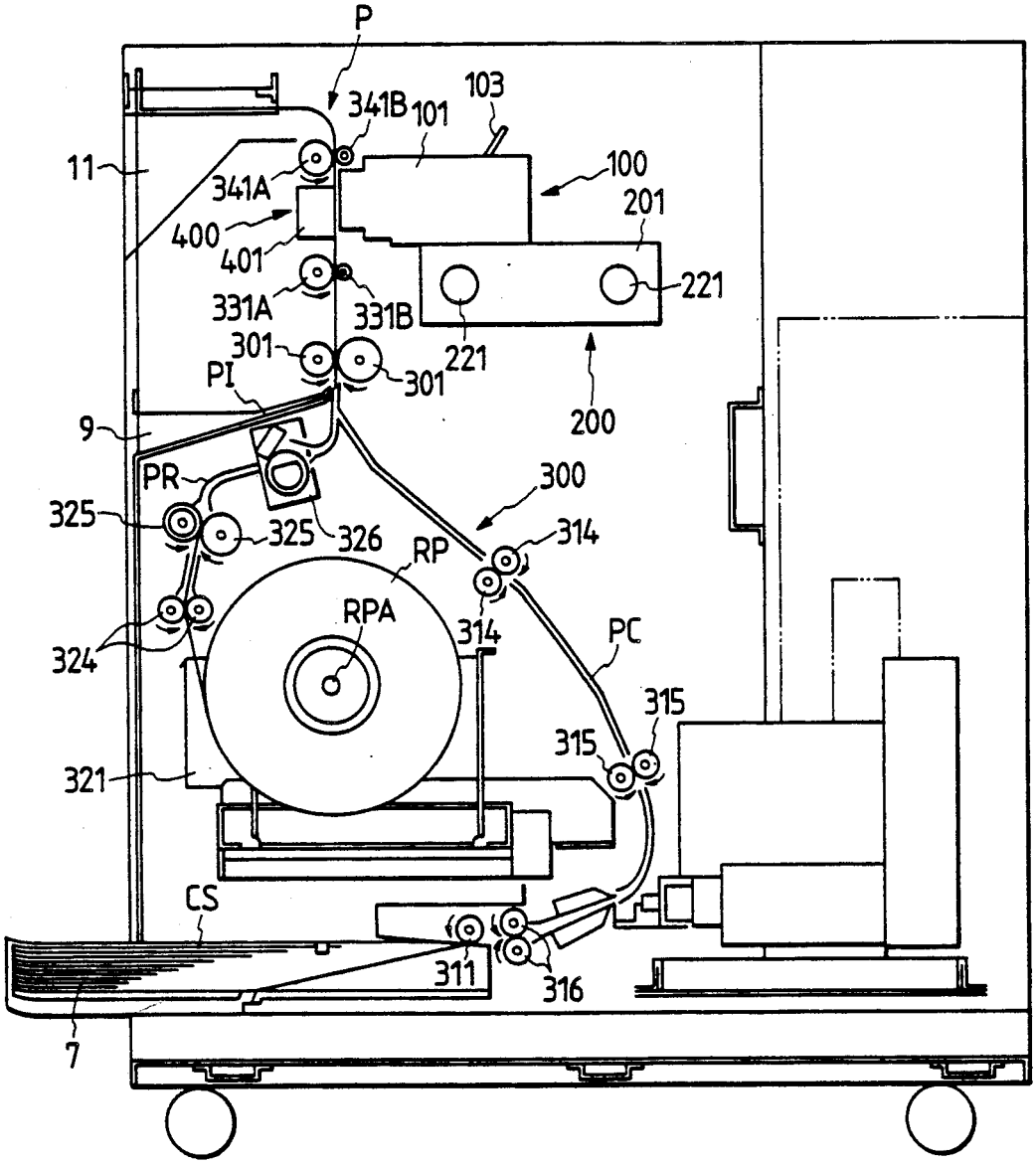
FIG. 2 is a side sectional view showing an internal structure of mainly a recording medium conveying system of the apparatus shown in FIG. 1.

FIG. 2 is a side sectional view of the ink-jet apparatus shown in FIG. 1. The internal arrangement centered on the recording medium conveying system will be generally described with reference to FIG. 2. The apparatus mainly comprises the following components.

(1) Recording System 100

A recording system 100 is a system including a recording head 101 and an ink tank and supplies an ink to the recording head 101 through through an ink supply tube 103. The detailed arrangement of the recording system 100 will be described in detail with reference to FIGS. 14 to 18.

(2) Recording System Unit Conveying System 200

A recording system unit conveying system 200 carries the recording head 101 and guides the recording head 101 along guide rails 221 in a predetermined direction (a direction perpendicular to the surface of the drawing in this case). The recording system unit conveying system 200 includes a carriage 201 for scanning the recording head 101 on the recording medium and other components and will be described together with the recording system 100 with reference to FIGS. 14 to 18.

(3) Recording Medium Conveying System 300

A recording medium conveying system 300 includes conveying paths P, PC, PR, and PI of the recording medium, conveying rollers, and a guide used for setting the recording medium (to be described later with reference to FIGS. 19 to 28).

(4) Air System 400

An air system 400 is connected to a platen 401 opposite thereto to flatten the recording surface of the conveyed recording medium and is connected to a cap portion (not shown in FIG. 2) opposite to the recording head 101 outside the recording range to supply air to the cap portion, thereby cleaning a portion near the ink discharge port of the recording head 101. An air suction source and an air supply source are constituted by one blower. The arrangement of the air system 400 will be described in detail with reference to FIGS. 3 to 13.

(5) Control System 500 (not shown in FIG. 2)

A control system 500 is a system for controlling the overall operation of the apparatus and will be described in detail with reference to FIGS. 29 to 31.

Referring to FIG. 2, recording media such as cut sheets CS (e.g., recording sheets, coated sheets, or plastic sheets) are stacked in the cassette 7. Another recording medium such as a roll of paper RP (e.g., elongated recording paper, coated paper, or plastic sheet) is rotatably mounted on a rotating shaft RPA. The cut paper CS, the roll of sheet RP, and a recording medium inserted in the manual feed port 9 are conveyed through conveying paths PC, PR, and PI. The conveying paths PC, PR, and PI merge near a clamping position of conveying rollers 301.

Each cut sheet CS separated from other sheets in the cassette 7 in cooperation with pickup rollers 311 and a separating member (not shown) such as a separation pawl is guided in the conveying path PC. The cut sheet CS is clamped by rollers 316, 315, and 314 arranged along the conveying path PC and is guided therealong to the conveying rollers 301. Set rollers 324 for taking up the recording medium RP from the roll and guiding the recording medium RP to the path, rollers 325 for conveying the recording medium RP to the conveying rollers 301, and a cutter 326 for cutting the roll paper RP by a predetermined length are arranged along the conveying path PR. The paper RP is held by a holder 321.

The recording medium (CS/PR) guided to the conveying rollers 301 through the path PC, PR, or PI is guided to the platen 401 through lower conveying rollers 331A and 331B (e.g., registration rollers) located at the upstream side of the conveying path P near the platen 401. The recording medium is further clamped by upper conveying rollers 341A and 341B located in the downstream direction near the platen 401 along the conveying path P. During this conveyance, recording is performed with the recording head 101, and the recorded medium is exhausted outside through the exhaust port 11. Clamping of the leading end of the recording medium (CS/PR) by the upper conveying rollers 341A and 341B prior to recording will be described with reference to FIGS. 19 to 28 which disclose an embodiment of the present invention. According to this embodiment, the guide is set to oppose the platen 401 to smoothly set the recording medium.

Air System, etc.

Figure 3:
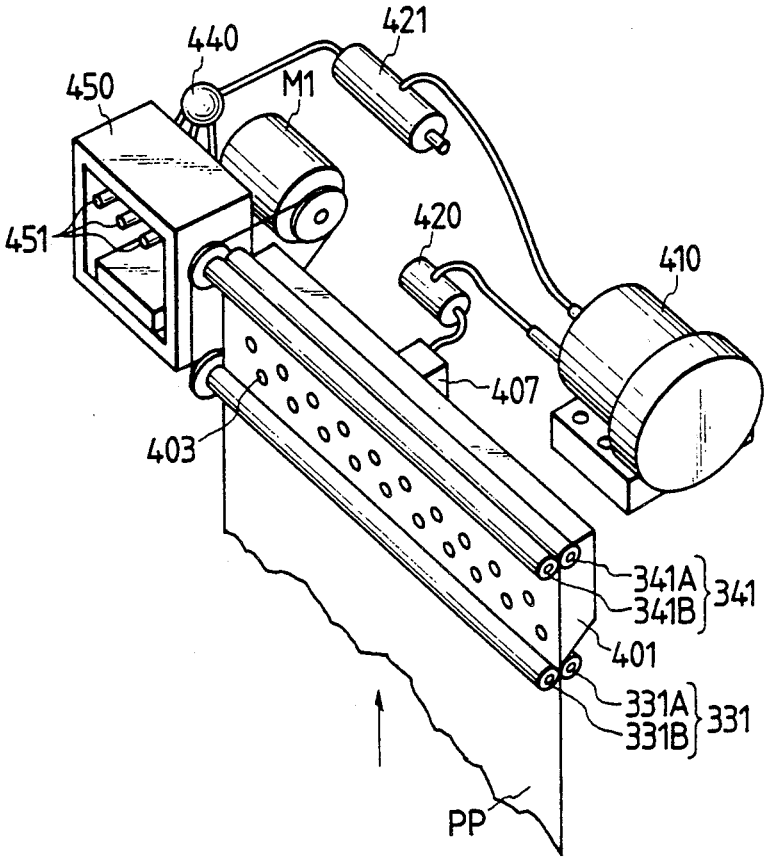
FIG. 3 is a perspective view showing an arrangement of an air system in the apparatus shown in FIG. 1.
Figure 4:
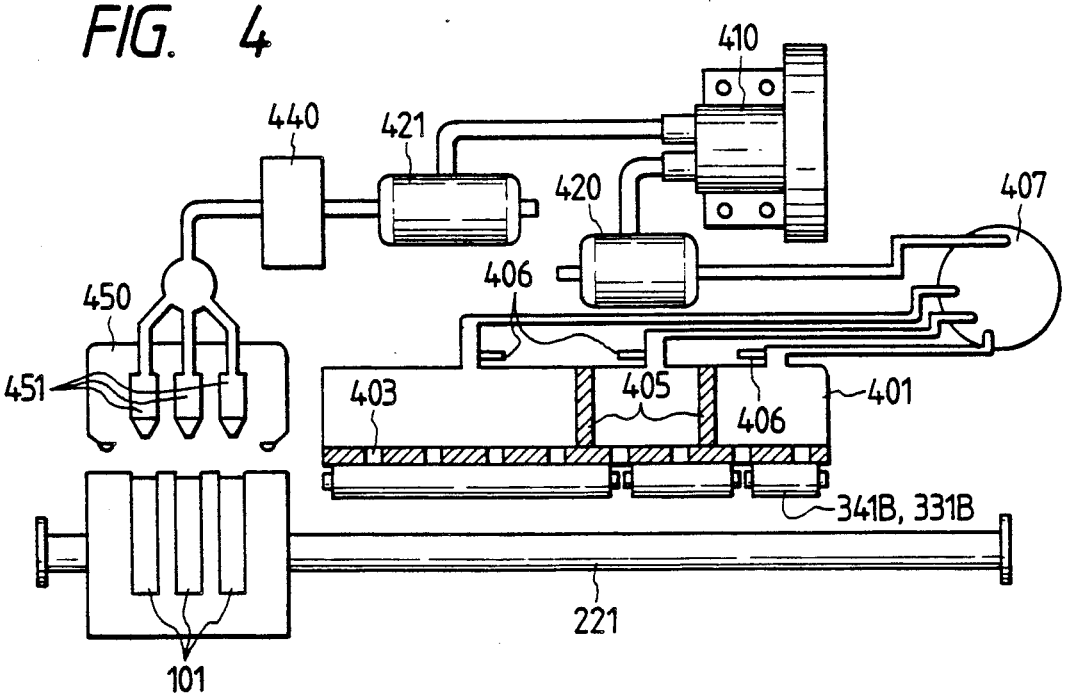
FIG. 4 is a view illustrating the air system.

FIGS. 3 and 4 are a perspective view and a view illustrating a schematic arrangement of the air system 400. Referring to FIGS. 3 and 4, a cap portion 450 covers the surface (discharge surface) with discharge ports of the recording head 101. The cap portion 450 is arranged outside the recording range of the recording head 101. A blower 410 is arranged to draw air from the platen 401 or supply air to the cap portion 450. A single blower 410 is used as an air suction source and an air supply source.

Partition walls 405 are formed to partition a suction portion of the platen 401 so as to correspond to the width of a recording medium PP. A distributor 407 is arranged to select the width of the suction portion in accordance with the width of the selected recording medium PP. A distributor disclosed in Japanese Patent Application No. 62-62475 filed by the present applicant can be used as the distributor 407. A pressure control valve 406 is arranged for each suction portion to maintain at a proper value a negative pressure generated within the suction portion upon suction operation of the blower 410, that is, a contact force between the recording medium PP and the platen 401 so as not to prevent smooth conveyance of the recording medium PP. The pressure control valve 406 comprises a spring member having a predetermined spring constant and a valve body. When a negative pressure exceeding the predetermined value is generated, the spring member is flexed to cause the suction portion to communicate with the atmospheric air.

Switching valves 420 and 421 are arranged between the blower 410 and the distributor 407 and between the blower 410 and the cap portion 450, respectively. The switching valve 420 is operated to switch the suction path to the distributor 407 or the atmospheric air. During recording, the switching valve 420 is switched to the distributor 407. However, during cleaning of the ink-jet surface, the switching valve 420 is switched to the atmospheric air side. The switching valve 421 is operated to switch the air supply path to the cap portion 450 or the atmospheric air. During recording, the switching valve 421 is switched to the atmospheric air. During cleaning of the discharge surface, the switching valve 421 is switched to the cap portion 450. A filter 440 is inserted between the switching valve 421 and the cap portion 450. The filter 440 prevents dust or paper dust from entering the cap portion 450 during discharge port cleaning for supplying air to the cap portion 450.

An air guide nozzle 451 is arranged at the end of the air supply path within the cap portion 450. The nozzle 451 is located at a proper position where a high-speed air jet is supplied to each discharge surface. For example, three nozzles are provided to supply high-speed air jet to the heads 101 when each head 101 opposes the cap portion 450 if the recording heads 101 use three inks (yellow (Y), magenta (M), and cyan (C)). If an effect obtained by high-speed air jet is sufficiently obtained, the nozzles need not be arranged in one-to-one correspondence with the recording heads. However, when the inks having different colors tend to be mixed, the air guide nozzles must be respectively arranged for the recording heads or in units of heads for injecting the same colors.

Referring to FIG. 3, a biasing roller 331B biases the recording medium PP against a main roller 331A. The rollers 331A and 331B constitute lower conveying rollers 331. Similarly, main and biasing rollers 341A and 341B constitute upper conveying rollers 341. A motor M1 is arranged to drive the upper conveying rollers 341. The biasing rollers 341B and 331B are split rollers, as shown in FIG. 4. Split portions (connecting portions between the split rollers) which do not contribute to biasing of the main rollers 341A and 341B do not oppose the partition walls 405.

The components of the air system will be described in detail below.

Figure 5:
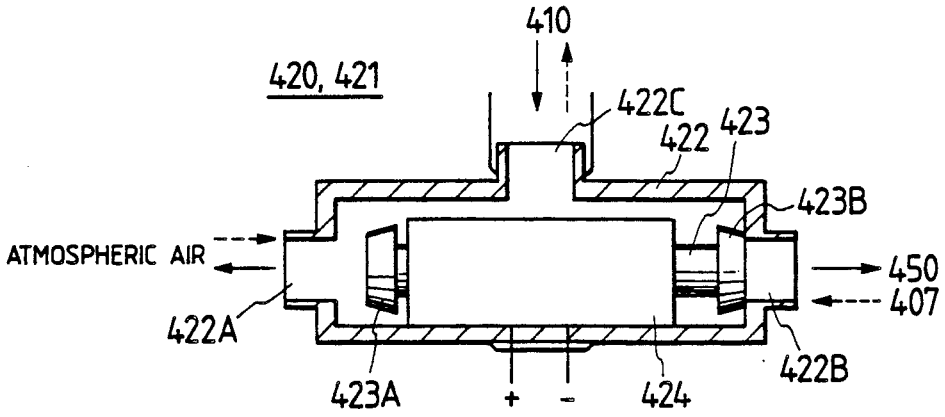
FIGS. 5 and 6 are sectional views respectively showing two arrangements of a switching valve employed in the air system.

FIG. 5 shows an arrangement of the switching valve 420 or 421. Solid arrows represent air flows when the switching valve is the valve 421. Dotted arrows represent air flows when the switching valve is the valve 420.

A cylindrical switching valve 422 comprises a communication portion 422C formed in the outer surface of the cylinder to communicate with the blower 410, a communication portion 422A formed at one end of the cylinder to communicate with the atmospheric air, and a communication portion 422B formed at the other end to communicate with the cap portion 450 or the distributor 407. Valve bodies 423A and 423B adapted to close the communication portions 422A and 422B upon movement of a shaft 423 are arranged at both end portions of the shaft 423 movable along the axial direction of a cylindrical body 422. When a solenoid 424 is driven to move the shaft 423 to the right, the switching valve 422 allows communication between the blower and the atmospheric air. However, when the shaft 423 is moved to the left, the switching valve 422 allows communication between the blower 410 and the cap 450 or the distributor 407.

During image recording, the atmospheric air communication portion 422A of the switching valve 420 is closed to allow the blower 410 to communicate with the distributor 407. The communication portion 422B of the switching valve 421 with the cap portion 450 is closed to allow the blower 410 to communicate with the atmospheric air. In this state, the blower 410 is driven. Then, an air flow from the blower 410 to the atmospheric air through the atmospheric air communication portion 422A of the switching valve 421 is formed. A negative pressure is generated at the suction portion of the platen 401 selected by the distributor 407, and the recording medium PP is chucked to the platen and is kept flat.

During cleaning of the recording head 101, the communication portion 422B of the switching valve 420 with the distributor 407 is closed to allow the blower 410 to communicate with the atmospheric air. The atmospheric air communication portion 422A of the switching valve 421 is closed to allow the blower 410 to communicate with the cap portion 450. In this state, the blower 410 is driven. Air is drawn from the atmospheric air communication portion 422A of the switching valve 420. Compressed air is supplied to the cap portion 450 by the blower 410 through the switching valve 421 and the filter 440. A high-speed air jet is supplied from the nozzle 451 to the discharge surface.

According to this embodiment, a single blower 410 is used to clean the ink-jet surface of the recording head 101 and to chuck the recording medium PP on the platen 401. As compared with the arrangement wherein the blower and its drive motor are separately arranged, the number of components and noise can be reduced, and a compact, lightweight, inexpensive apparatus can be provided.

In this embodiment, the switching valve 421 is inserted between the blower 410 and the cap portion 450. During recording, the switching valve 421 communicates with the atmospheric air and the path to the cap portion 450 is blocked. Therefore, a problem caused by the direct connection between the blower 410 and the cap portion 450, i.e., a problem caused by an increase in exhaust load resistance upon restriction of the flow path by the nozzle 451 to reduce a suction force can be prevented. A problem caused by quick drying of the recording head 101 and the cap portion 450 due to constant spraying of the air jet from the nozzle during suction to result in non-discharge of the ink can be prevented. In addition, a problem caused by frequent driving/interruption of the blower 410 to shorten the service life of the blower motor can be prevented.

The switching valve 420 is inserted between the blower 410 and the distributor 407. During non-recording such as cleaning, the switching valve 420 communicates with the atmospheric air and the communication path to the distributor 407 is blocked. The problems caused by the direct connection between the blower 401 and the distributor 407 can be prevented. More specifically, a problem caused by constant suction to prevent smooth feed of the recording medium PP during setting thereof (to be described later) can be prevented. A problem caused by interruption of the blower to perform optimal setting of the recording medium PP to prolong the wait time in addition to the time required for cleaning can be prevented. In addition, a problem caused by an increase in repetitive operations, ON/-OFF operations of the blower motor to shorten the service life of the blower motor can be prevented.

The arrangement of the switching valves 420 and 421 is not limited to the one illustrated in FIG. 5. Various changes and modifications may be made, as shown in FIG. 6.

Figure 6:
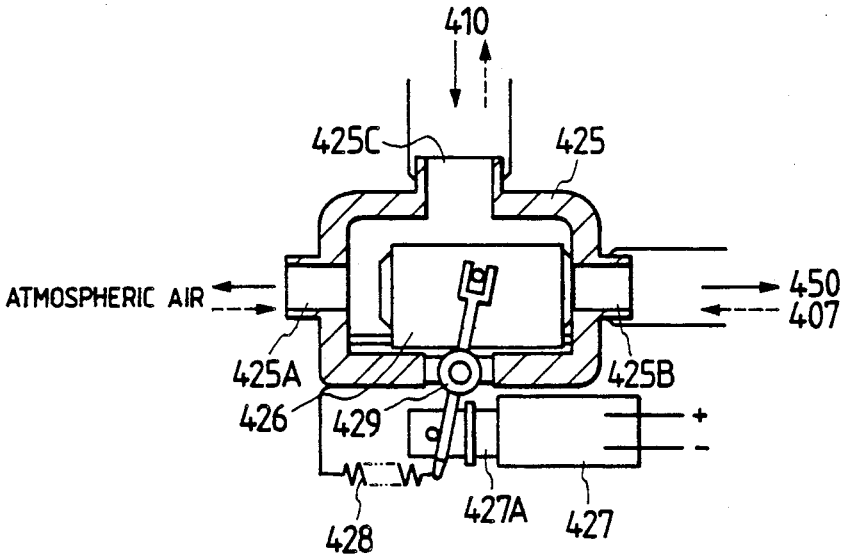

Referring to FIG. 6, a valve body 426 capable of closing a communication portion 425A or 425B is slidably fitted in a switching valve body 425 having the communication portion 425A, the communication portion 425B for communicating with the cap portion 450 or the distributor 407, and a communication portion 425C for communicating with the blower 410. A solenoid 427 arranged outside the body 425 and the valve body 426 are coupled through a link 429. In order to allow communication between the atmospheric air and the blower 410, the solenoid 427 is deenergized, and a plunger 427A is located at the illustrated position by the biasing force of a spring 428. In order to obtain communication between the blower 410 and the cap portion 450 or between the blower 410 and the distributor 407, the solenoid 427 is energized to retract the plunger 427A against the biasing force of the spring 428, thereby closing the atmospheric air portion 425A. With this arrangement, the same effect as obtained in FIG. 5 can be obtained. In the arrangement shown in FIGS. 3 and 4, the switching valves 420 and 421 are open to the atmospheric air, and cleaning of the communication paths can be performed.

Figure 7:
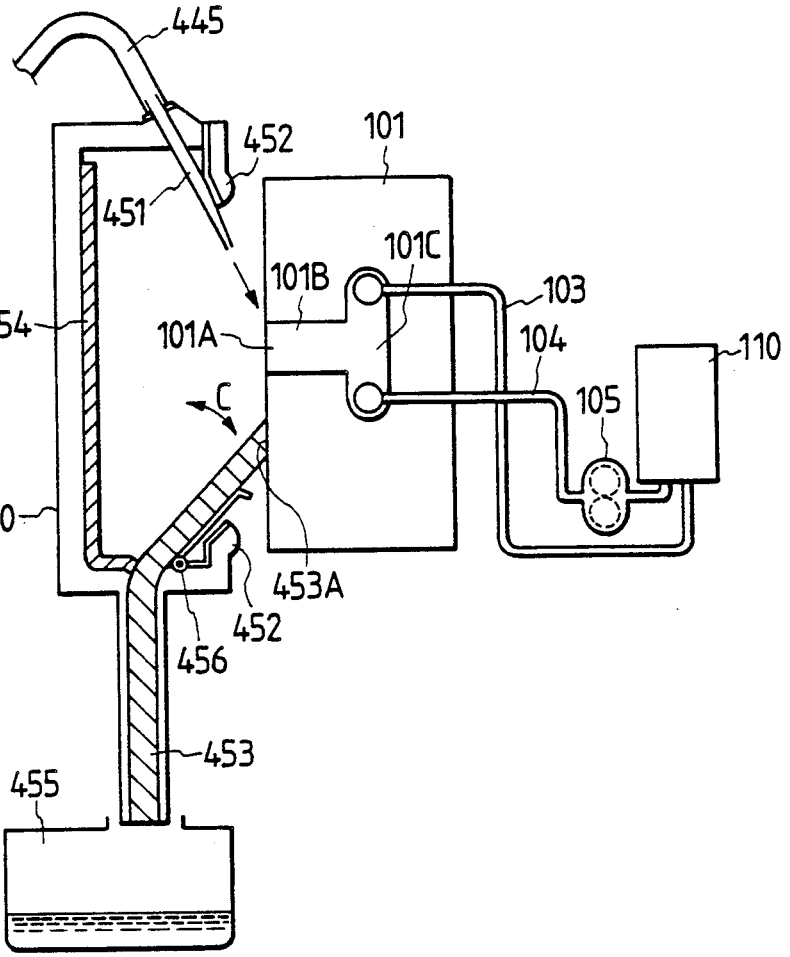
FIG. 7 is a sectional view showing an arrangement of a cap portion coupled to the air system.

FIG. 7 shows an arrangement of the cap portion 450. The cap portion 450 is brought into contact with the front surface of the recording head 101 to cover a discharge surface 101A. The cap portion 450 includes an elastic member 452 such as a rubber member brought into contact with the front surface of the head 101 to damp the impact force at the time of contact between the cap portion 450 and the head 101. The cap portion 450 also includes a band-like ink absorbing member 453 extending from an end 453A located inside the cap portion 450 to an exhaust ink tank 455 outside the cap portion 450. The ink absorbing member 453 is adapted to engage with the lower front surface of the recording head 101. An end 453A of the ink absorbing member 453 is supported by a spring 456 inside the cap portion 450 and is displaced in a direction indicated by an arrow C and appropriately engaged with an engaging portion of the front surface of the head 101. An ink absorbing member 454 is formed on the inner wall surface of the cap portion 450. A tube 445 connects a nozzle 451 for supplying a high-speed air jet from the upper direction of the discharge surface 101A and the filter 440 (FIGS. 3 and 4).

Nozzles 101B are formed by a plurality of vertical flow paths. Discharge energy generating elements such as electrothermal conversion elements are connected to the nozzles 101B. An ink chamber 101C supplies the ink to each flow path and is connected to the ink tank 110 through supply pipes 103 and 104. A gear pump 105 is arranged in one supply pipe 104 as a discharge recovery process for removing bubbles and dust entering in the supply paths and the nozzles 101B and for removing the ink whose viscosity is abnormally increased. The gear pump 105 supplies the ink under pressure to the ink supply system to exhaust the ink from the discharge port.

The ink exhausted by discharge recovery process with ink supply under pressure is collected by the ink absorbing member 453 and is guided to the exhaust ink tank. Ink drops left on the discharge surface and dust during cleaning by spraying of an air jet from the nozzle 451 are also collected by the ink absorbing member 453

As not shown in FIG. 7, the rear surface of the cap portion 450 in association with cleaning can be opened to prevent disturbance of the air flow from the nozzle 451 in the cap portion 450.

Figure 8:
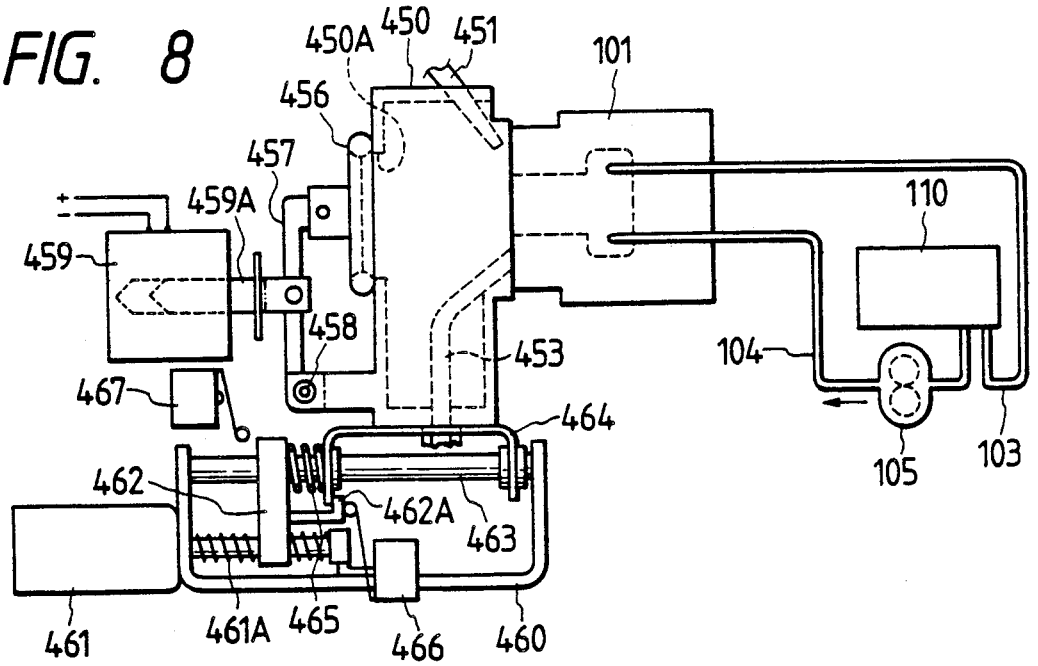
FIGS. 8 and 9 side views respectively showing two arrangements of the cap portion and its moving mechanism.

FIG. 8 shows an arrangement near the cap portion 450 and a moving mechanism for bringing the cap portion 450 into contact with the recording head 101 or separating it therefrom. An opening 450A is formed on the rear wall surface of the cap portion and can be opened/closed through a door 456. The door 456 is supported by a pivot lever 457 pivotally about a pivot pin 458, and the lever 457 is connected to a plunger 459A of a solenoid 459. More specifically, the plunger 459A is retracted upon energization of the solenoid 459, and the lever 457 is pivoted counterclockwise about the pivot pin 458, thereby opening the opening 450A. Upon deenergization of the solenoid 459, the plunger 459A is moved forward by the biasing force of a spring (not shown), and the lever 457 is pivoted clockwise to cause the door 456 to close the opening 450A.

A base 460 is fixed on the apparatus, and a cap feed motor 461 is fixed on the base 460. Threads are formed on the surface of a motor shaft 461A. A moving link 462 is threadably engaged with the motor shaft 461A. Upon rotation of the motor shaft 461A, the link 462 is reciprocally moved along a cap guide 463. A cap base 464 carries the cap portion 450 and is connected to the link 462 through a spring 465 and latched to a latch 462A formed on the link 462.

A switch 466 detects that the cap portion 450 is located in the forward position (capping position) when the cap portion 450 is in contact with the recording head 101. A switch 467 detects a retracted position (cap-off position) when the cap portion 450 is separated from the recording head 101.

With the above arrangement, when capping is to be performed, the cap feed motor 461 is rotated in the forward direction, and the cap base 464 is moved to the capping position through a screw feed mechanism consisting of the motor shaft 461A and the link 462. When the capping is detected by the capping position detection switch 466, the motor 461 is stopped. At this time, since the cap base 464 is kept engaged with the spring 464 through the link 462, the impact force upon contact between the cap portion 450 and the recording head 101 can be effectively absorbed. Therefore, the recording head 101 can be protected during non-use of the apparatus in the capping state. Discharge recovery by using a compressed ink from the gear pump 105 can be performed.

When the discharge surface 101A is cleaned in association with the discharge recovery, the solenoid 459 is energized to open the door 456. In this state, when a high-speed air jet is sprayed from the nozzle 451, the sprayed air is exhausted through the opening 450A, and a stable air flow without disturbance can be formed. The contamination of the contact between the cap portion 450 and the recording head 101 and on the front surface of the recording head 101 can be prevented.

At the end of cleaning or during the cap-off state, the solenoid 459 is deenergized to close the opening 450A. The motor 461 is rotated in the reverse direction to retract the link 462. During retraction, the cap base 464 latched by the latch 462A is separated from the recording head 101. The cap portion 450 is located at a predetermined position where the cap-off position detection switch 467 is operated.

According to this embodiment as described above, the positions of the cap portion 450 can be only two. As compared with the case wherein the cap portion 450 is slightly separated from the recording head 101 so as to obtain a stable air flow, positional control can be simplified.

The arrangement of the cap moving mechanism is not limited to the one shown in FIG. 8, and various changes and modifications thereof may be made. For example, a solenoid need not be arranged to open the door 456. The motor 461 may be used to open/close the door.

Figure 9:
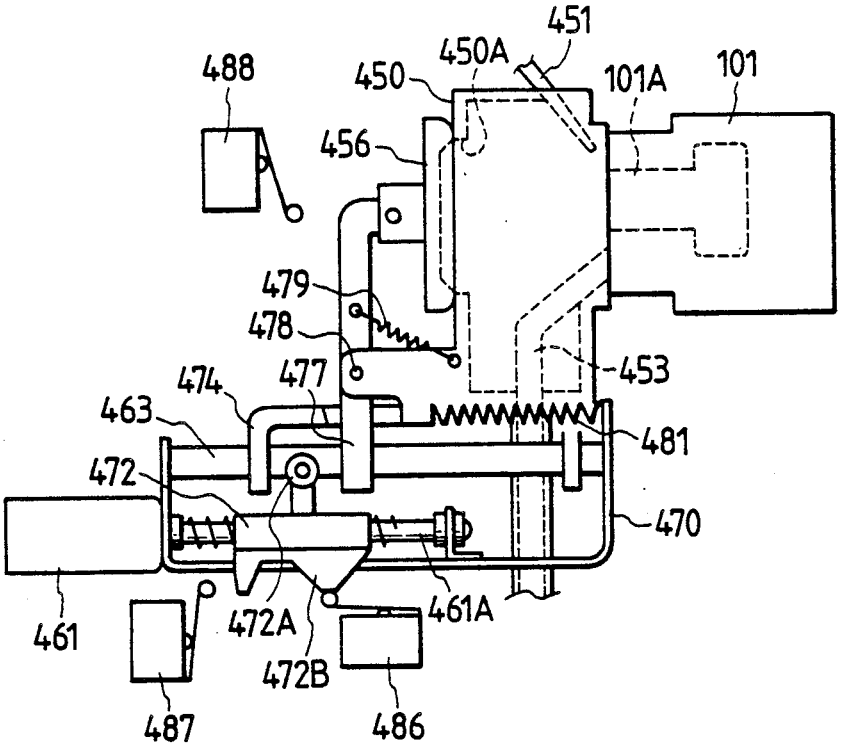

FIG. 9 shows another arrangement of the cap moving mechanism. In this arrangement, the cap base 474 which carries the cap portion 450 is biased to the right by a tension spring 481 hooked between itself and a fixed base 470. When an external force does not act, the cap portion 450 abuts against the fixed base 470 and is located at a position where it contacts the recording head 101. A threaded motor shaft 461A is threadably engaged with a link 472 which can be reciprocally moved. A cap base 474 and a roller 472A engageable with the other end of a door support lever 477 are mounted on the link 472. The lever 477 is pivotal about a pivot pin 478 extending on the cap portion 450 and is always biased clockwise by a tension spring 479 hooked between the lever 477 and the cap portion 450.

A switch 486 can be engaged with a portion 472B of the link 472 to detect a capping position, and a switch 487 can be engaged with the portion 472B to detect the cap-off position. A switch 488 is fixed on the cap portion to engage with the lever 477, thereby detecting an open state of the door 456.

With the above arrangement, the link 472 is located at the retracted position during the cap-off state. Upon engagement between the roller 472A and the cap base 474, the cap portion 450 is separated from the recording head 101. When the motor 461 is rotated in the forward direction so as to perform capping, the roller 472A is moved to the right. Upon this movement, the cap base 474 is simultaneously moved to the right by the biasing force of the spring 481. At the contact position between the cap portion 450 and the recording head 101, the cap portion 450 abuts against the base 470 and the switch 486 detects the capping state. In this state, the motor is temporarily stopped. The recording head 101 during non-use of the apparatus can be protected, and the discharge recovery under pressure can be performed.

When the discharge surface 101A is cleaned in association with the discharge recovery, the motor 461 is further rotated in the forward direction. In this case, the cap portion 450 is kept in the capping position, and only the link 472 is moved to the right. The roller 472A is engaged with the lever 477 and is pivoted counterclockwise against the biasing force of the spring 479, thereby opening the door 456. When the open state of the door 456 is detected by the switch 488, the motor 461 is stopped. In this state, cleaning can be performed.

At the end of cleaning or during the cap-off state, the motor 461 is rotated in the reverse direction to move the link 472 to the left. The lever 477 is pivoted clockwise by the biasing force of the spring 479. The opening 450A is closed by the door 456. At the same time, the roller 472A causes the cap base 463 to move to the left against the biasing force of the spring 481. Upon detection by the switch 487, the cap portion 450 is kept at a position separated from the recording head 101.

In this arrangement, the same effect as in the arrangement of FIG. 8 can be obtained. In addition, the solenoid need not be used, and movement of the cap portion 450 and the mechanism for opening the rear surface can be achieved at low cost.

Arrangements of the platen 401 associated with the air system and the biasing rollers 331B and 341B will be described below.

Figure 10:
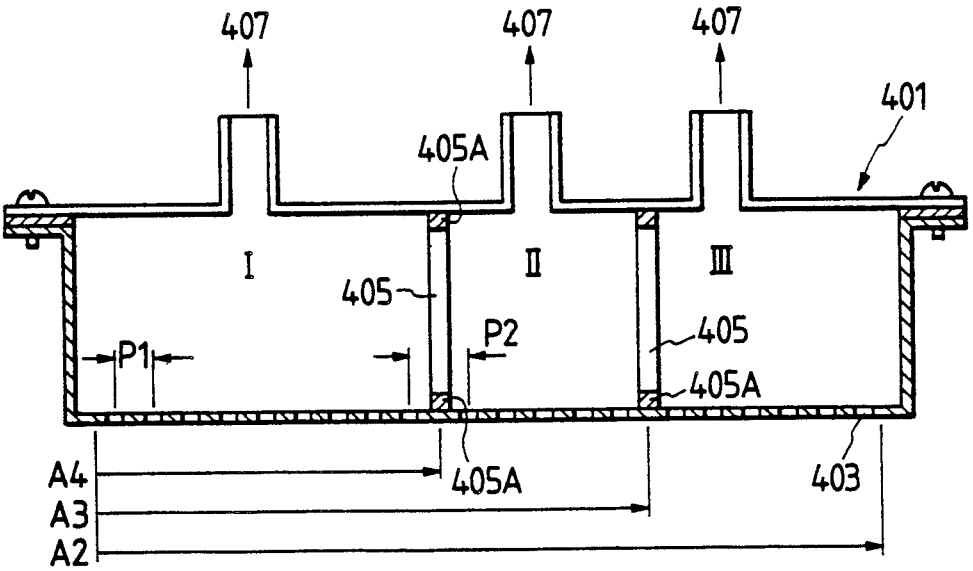
FIG. 10 is a cross-sectional view showing an arrangement of a platen coupled to the air system.

FIG. 10 shows an arrangement of the platen 401. In this case, recording media having A4, A3, A2, and A1 sizes can be selected. For this reason, the platen width is formed in correspondence with the long side (592 mm) of the A2 size. The partition walls 405 are spaced apart from each other by distances corresponding to the long side (296 mm) of the A4 size, and the long side (420 mm) of the A3 size from one side surface (i.e., conveying reference side). The distributor 407 is switched to select a suction portion size corresponding to the size of the recording medium. For example, a suction zone I is selected for the A4 size; zones I and II, for A3; and zones I to III, for A2 and A1 sizes Suction outside the range of the recording medium is not performed. Therefore, the recording medium can be appropriately chucked on the front surface of the platen 401.

A pitch p1 of suction holes 403 is preferably minimized to maximize the suction force for the recording medium. The partition walls 405 are formed by seal members 405A in the platen 401. The width of the partition walls 405 is preferably larger than the pitch p1 in consideration of a sealing effect. The roll of recording medium such as a roll of paper may be ramped in a zig-zag manner, and the right and left end positions of the recording medium may therefore vary. Therefore, the width of the partition walls 405 is preferably set to be larger than the pitch p1.

In this arrangement, the width of the partition walls 405 is set to be large, and a pitch p2 between the suction holes is larger than the pitch p1.

The relationship between the platen 801 and the biasing rollers 341B and 331B will be described below.

Figure 11:
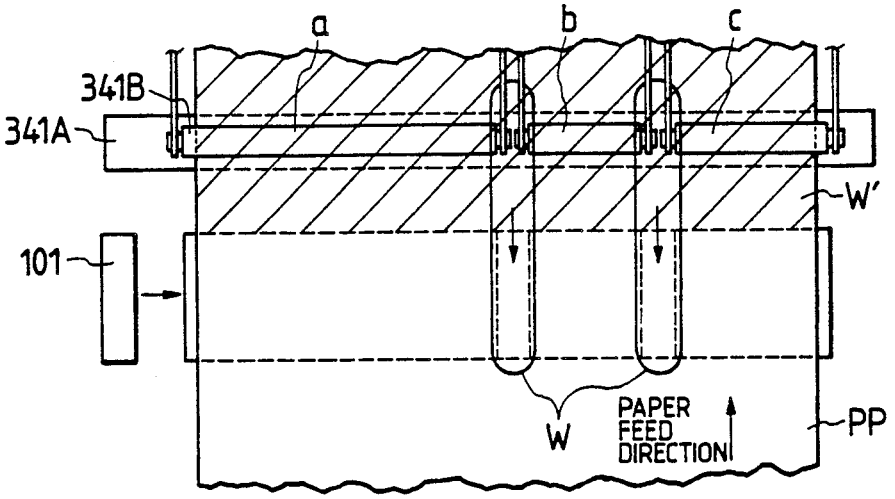
FIG. 11 is a view for explaining occurrence and growth of paper floating.
Figure 12:
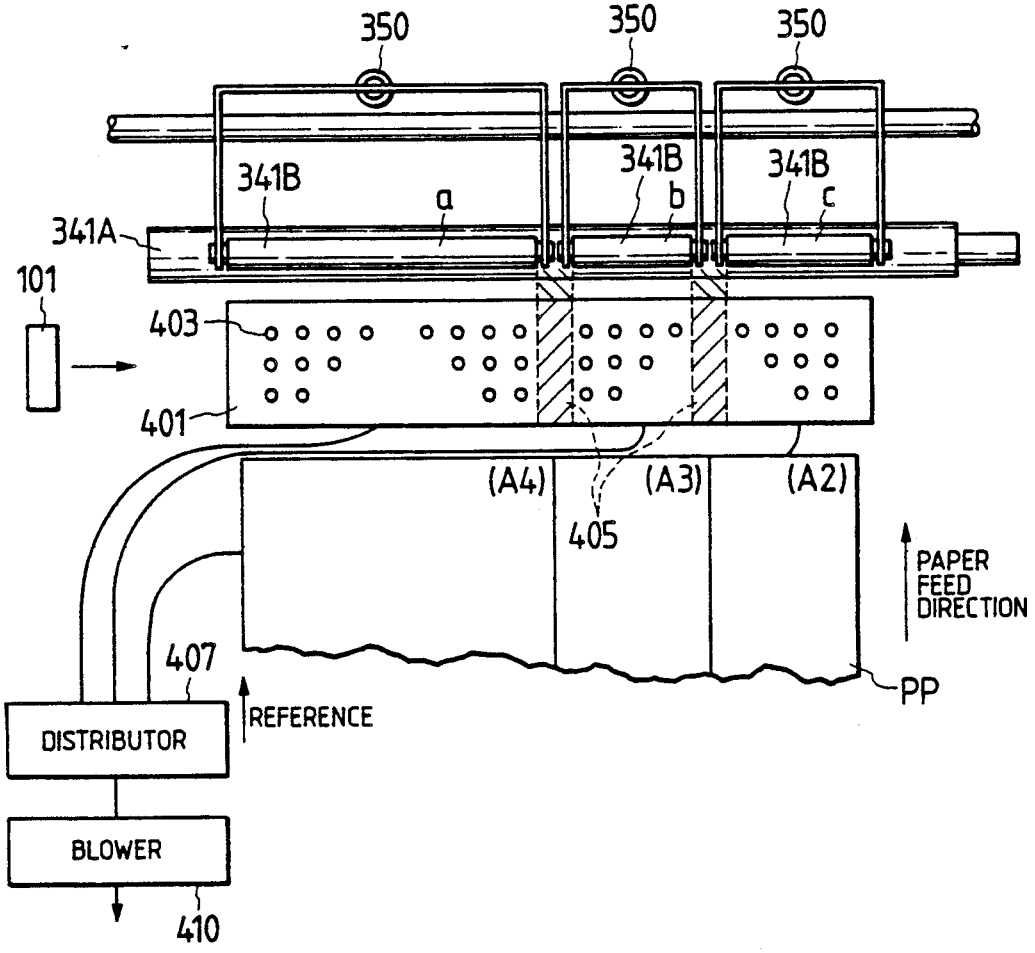
FIG. 12 is a view showing the relationship between the platen structure and the biasing roller structure when growth of paper floating occurs so as to compare with the embodiment of the present invention.

As shown in FIG. 11, the recording medium, PP recorded by the recording head 101 swells (area W') upon attachment of an ink if the recording medium is paper. In this state, the recording medium PP is conveyed to the conveying rollers 341A and 341B in a direction indicated by an arrow in FIG. 11. Each of the biasing rollers 341B and 331B is divided into three portions (a, b, and c) in accordance with the size of the recording medium. That is, the roller is divided by positions spaced apart from the one side surface of the conveying reference side by lengths of the long sides of the A4 and A3 sizes. When recording media having various sizes with reference to the one side surface of the platen 401 can be selected as in this embodiment, the above arrangement is very effective to prevent a ramp of the recording medium PP. However, when recording and conveyance are performed for the recording medium PP having a size larger than the minimum size (A4 size in this case), the split portions (connecting portions of the roller) of the biasing roller 341B cannot provide a suction force and a restriction force to the swelled area W'. Therefore, the swelled area floats, and paper floating W grows in a direction opposite to the convey direction. As shown in FIG. 12, if a nonsuction portion of the partition wall is present in the floating growth direction, paper floating W continuously grows on the front surface of the platen 401, thus degrading the quality of the image. The floating portion is brought into contact with the discharge surface of the recording head 101 to contaminate the discharge surface. In the worst case, the discharge surface is damaged.

Figure 13:
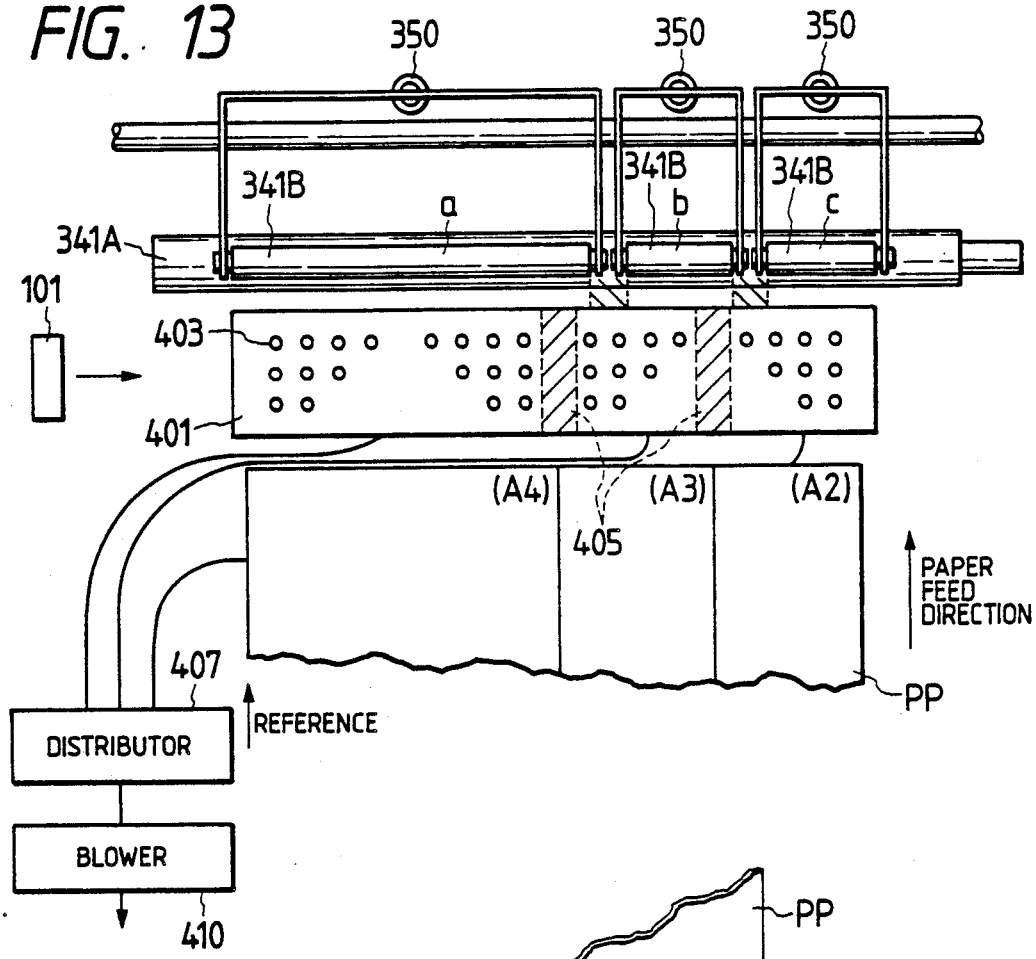
FIG. 13 is a view showing the relationship between the platen structure and the biasing roller structure.

In this embodiment, as shown in FIG. 13, the length of the split roller of at least the biasing roller 341B is selected such that the split portions of the biasing roller 341B are located at positions offset from the partition walls 405 in the conveying direction, i.e., at positions so as not to oppose the partition walls 405. Therefore, even if paper floating W occurs in a portion where the roller is not present, the recording medium can be restricted by the suction force on the platen 401. Growth of floating can be prevented, and the recording medium PP can be kept flat along the surface of the platen 401. Therefore, degradation of recording quality and damage to the recording head 101 can be prevented.

Recording System and Recording System Unit Conveying system

Figure 14:
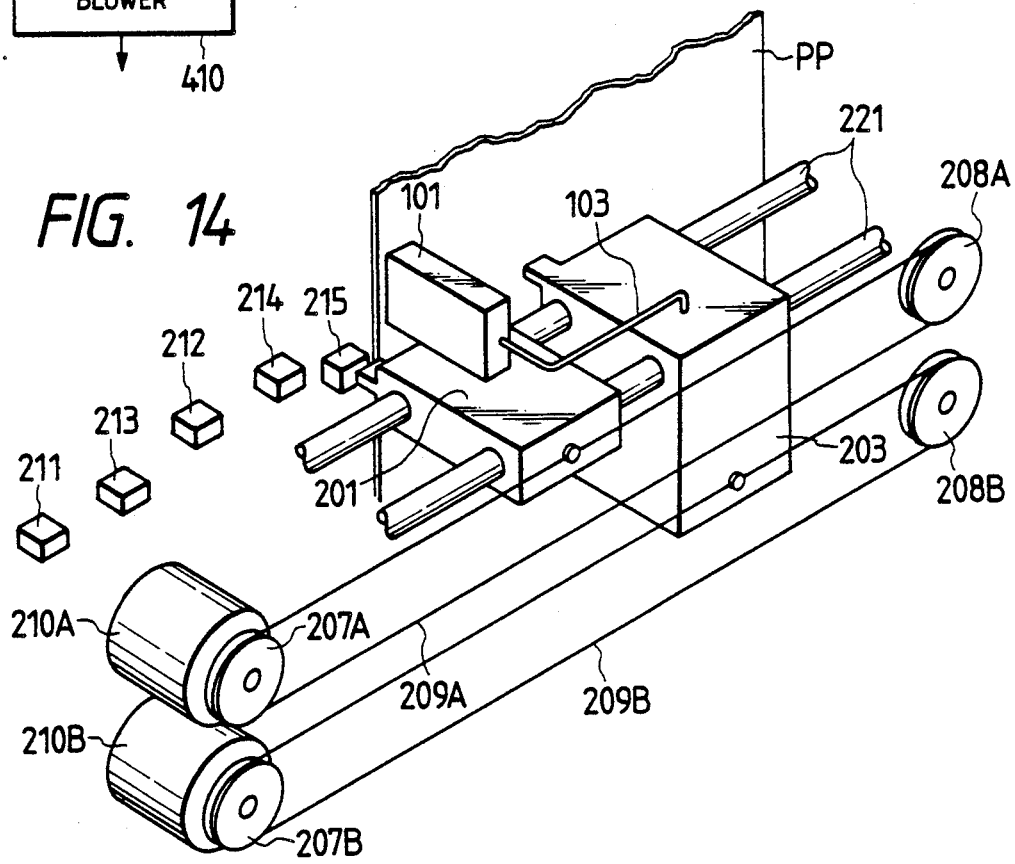
FIGS. 14 to 18 are perspective views respectively showing arrangements of a recording system and a recording system unit conveying system which are used in the present invention.

FIG. 14 shows an arrangement of the recording system 100 and the recording system unit conveying system 200. A carriage 201 carries the recording head 101, and a tank carriage 203 receives the ink tank 110 (FIG. 7) serving as an ink supply system. The carriage 201 and the tank carriage 203 are scanned along the guide rails 211. A wire 209A is looped between a pulley 207A and an idler 208A, and a wire 209B is looped between a pulley 207B and an idler 208B. The wires 209A and 209B are fixed to the carriage 201 and the tank carriage 203, respectively. Motors 210A and 210B are connected to the pulleys 207A and 207B, respectively. Upon rotation of the motors 210A and 210B, the carriages 201 and 203 are scanned through the wires 209A and 209B.

Sensors 211 and 212 detect home positions of the carriages 201 and 203, respectively. In particular, the home position sensor 211 is disposed in association with contact between the cap portion 450 and the recording head, thereby accurately performing capping Reverse position sensors 213 and 214 detect the reverse positions of the carriages 201 and 203 in the scanning direction when the recording head repeatedly scans the recording medium PP to continuously perform recording. An image leading end sensor 215 detects a driving timing of the recording head 101 when scanning is started to record an image on the recording medium PP.

Although omitted in FIG. 14, the recording head 101 and the ink tank 110 included in the tank carriage 203 are connected to the supply pipe 104. The gear pump 105 is connected to the supply pipe 104 to compress the ink (FIG. 7). The gear pump 105 may be mounted on the carriage 201 or the tank carriage 203.

In this embodiment, the carriage 201 which carries the recording head 101 and the tank carriage 203 which stores the ink tank 110 are driven by separate motors. This leads to a great advantage as compared to a system in which a tank for storing the ink to be supplied to the recording head is fixed to the main unit of the recording apparatus or a system in which the recording head and the ink tank are mounted on one carriage.

When the scanning distance of the recording head is considerably long, i.e., when the large recording medium such as A2 and A1 media can be used for recording, the length of the tube for supplying the ink to the recording head in the system having a fixed tank is excessive. The supply tube must have flexibility enough not to interfere with scanning of the recording head. When the tube length is excessively increased, the pipe resistance is undesirably increased and air is left in the tube.

In a system wherein the tank and the recording head are mounted together on one carriage, when an amount of recording solution stored in the tank is large, the frequency of replenishment can be preferably reduced. However, in order to obtain a high-quality image, high-precision scanning by the recording head is required, and a drive motor of a higher output power is required. In view of this, an increase in amount of liquid stored in the tank cannot be easily designed According to the present invention as compared with the above systems, the load acting on the carriage motor 210A is relatively small. Therefore, the carriage drive motor 210A need not have a high output power with high precision. Even if the drive motor 210B for driving the tank carriage 203 has a high output power, it does not require a precision as high as that of the motor 210A. In the arrangement of FIG. 14, the amount of ink stored in the tank 110 can be increased without increasing the output of a drive source of the carriage 201 which carries the recording head 101. In addition, the ink supply path can be shortened, and the ink can be smoothly supplied to the recording head 101. Therefore, highly precise recording with high quality can be performed on a large recording medium.

However, upon changes in inertial force due to ink consumption or the like, if slight slippage occurs between the wires 209A and 209B and the pulleys 207A and 207B or the idlers 208A and 208B and slight operation errors of the motors 210A and 210B occur, and these errors are accumulated, the carriage 201 may collide against the tank carriage 203 during recording to degrade recording quality. Alternatively, the carriage 201 may become abnormally separated from the tank carriage 203 to remove or disconnect the ink supply pipe 103 or 104.

In this embodiment, the distance between the carriages 201 and 203 is corrected at home positions and reverse positions every scanning cycle, every recording of one recording medium, or every plurality of scanning cycles. The carriages 201 and 203 are reset to the detection positions of the home position sensors 211 and 212 at proper timings. Alternatively, the carriages 201 and 203 are reset to the detection positions of the reverse position sensors 213 and 214.

With this operation, collision between the carriages by slippage between the wire pulleys and error accumulation of the motor operations, or the disconnection of the ink supply pipe can be prevented. The control modes will be described in detail with reference to FIGS. 30A to 30D and 31.

Figure 15:
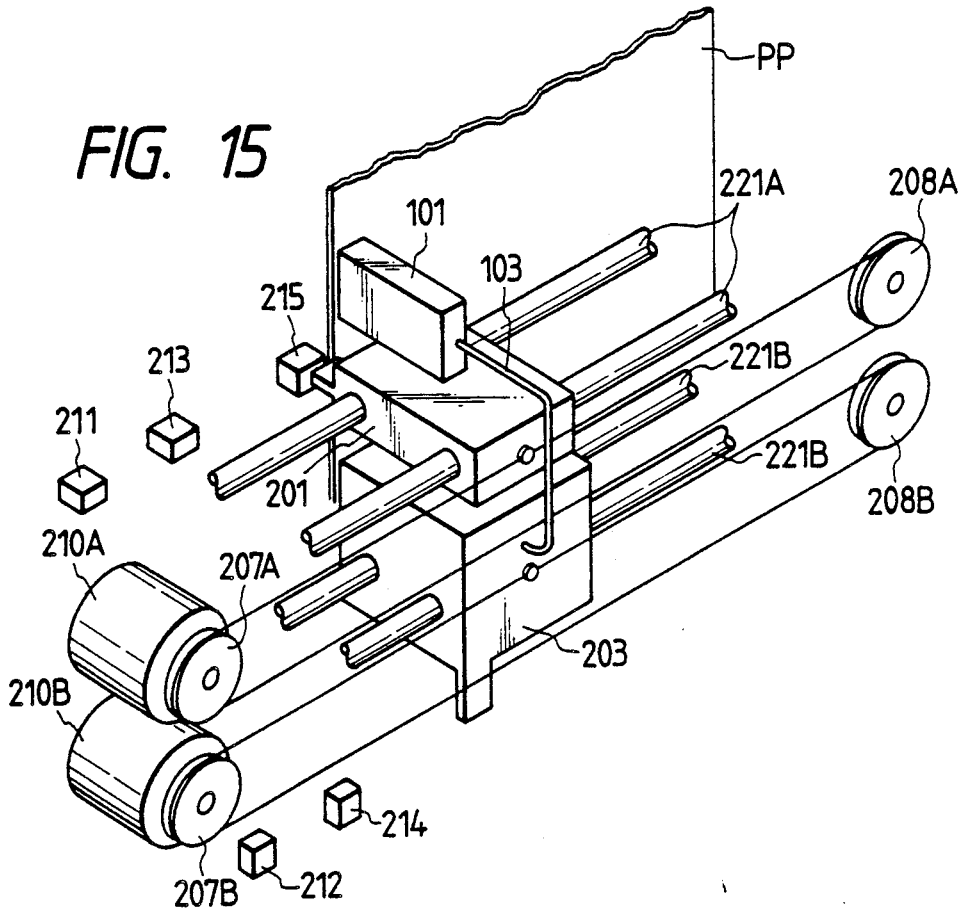

FIG. 15 shows another arrangement of the recording system 100 and the recording system unit conveying system 200. In this arrangement, the carriage 201 and the tank carriage 203 are offset in the feed direction of the recording medium PP and are guided along the guide rails 221A and 221B. With this arrangement, collision between both the carriages by slippage and error accumulation and associated problems do not occur. However, a disconnection of the ink supply pipes 103 or 104 may occur. The same control as in FIG. 14 must be performed in the arrangement of FIG. 15.

Figure 16:
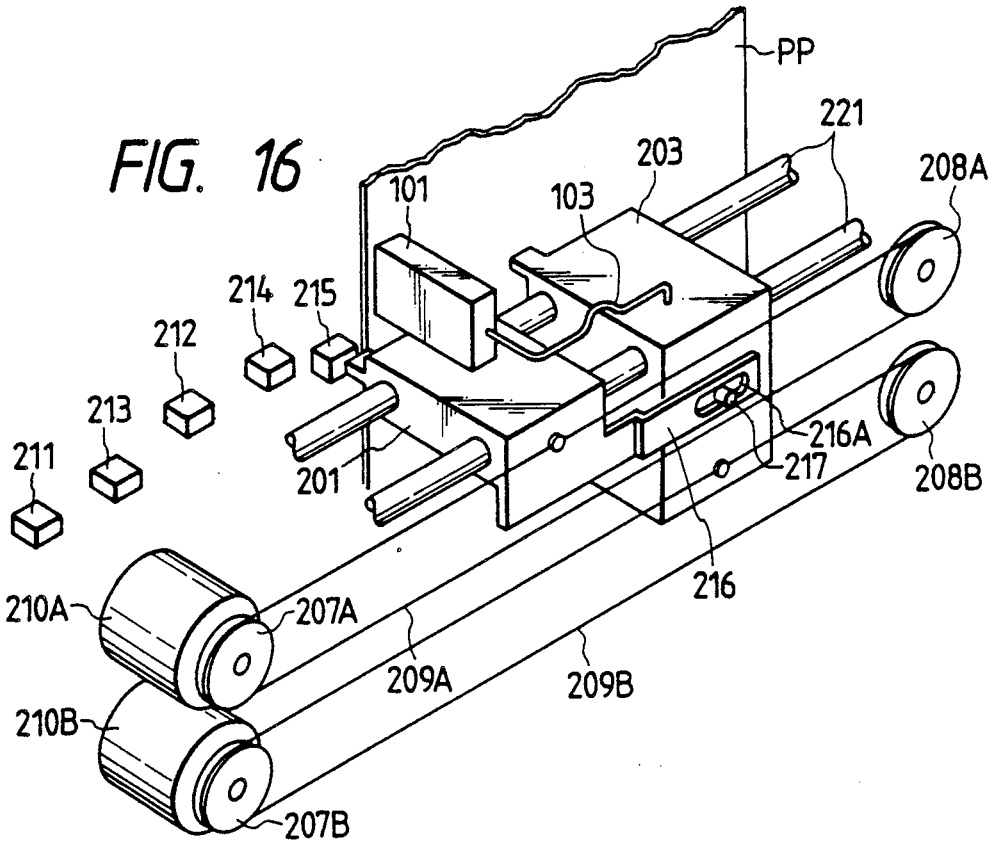
Figure 17:
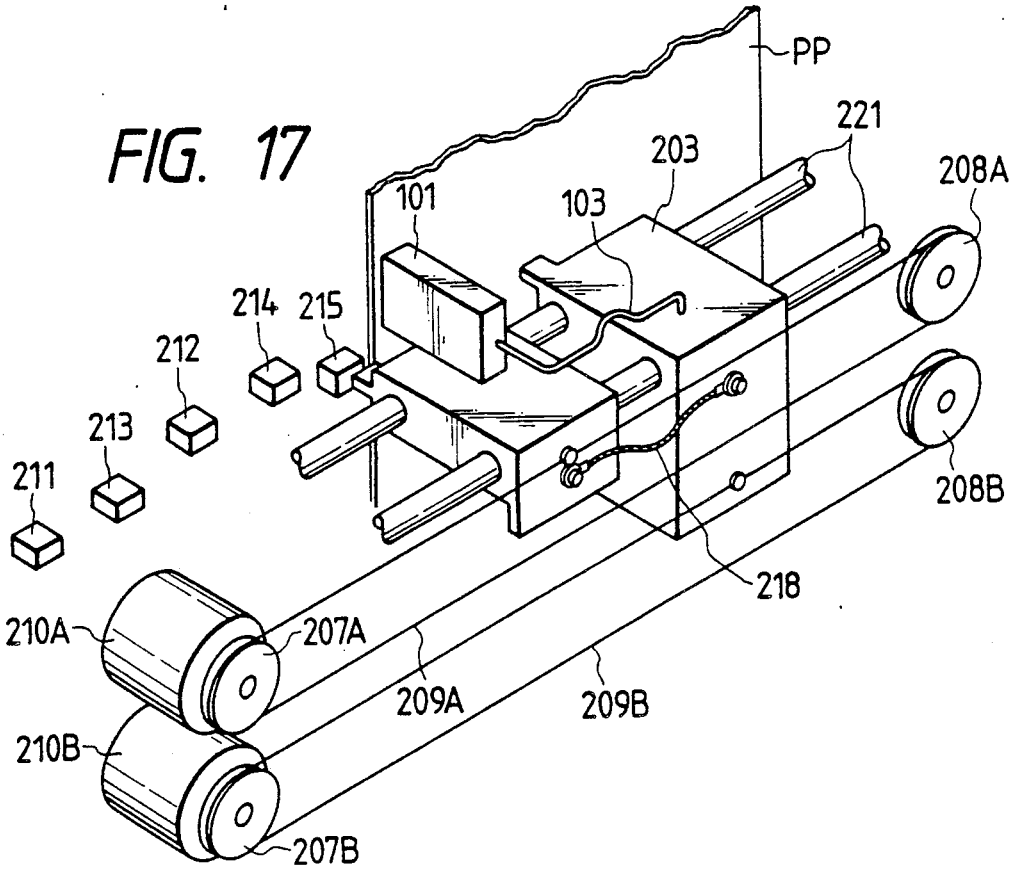
Figure 18:
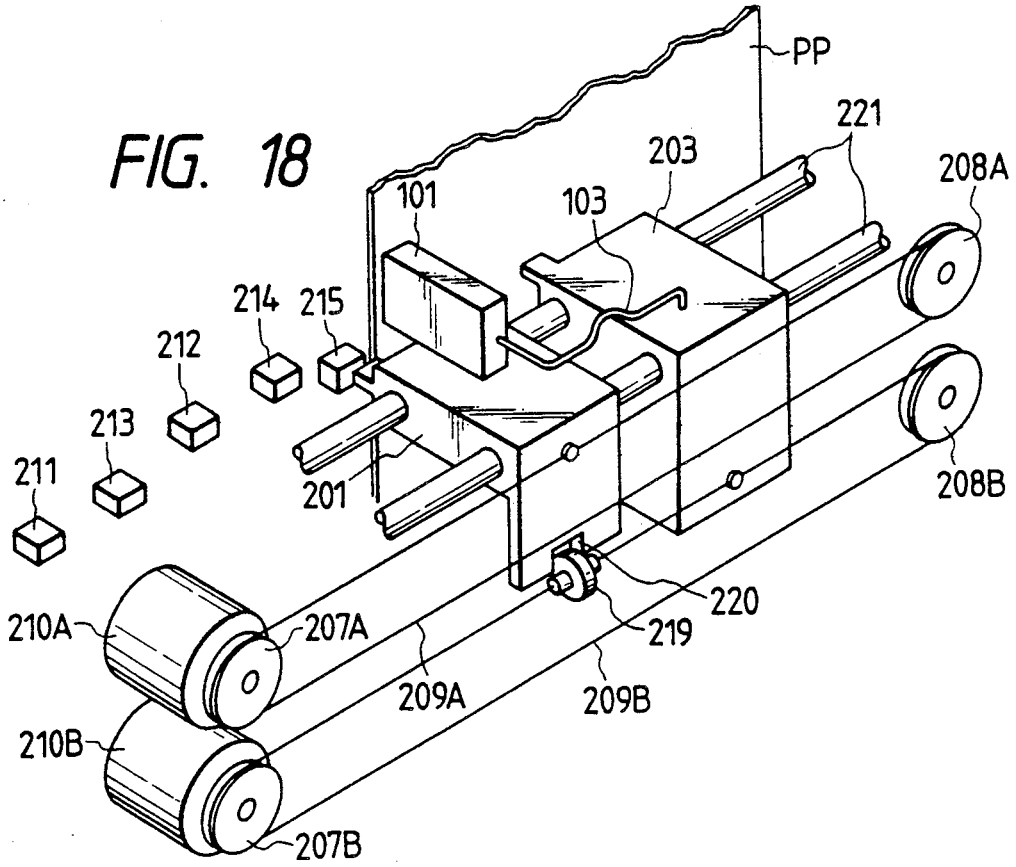

FIGS. 16 to 18 show three other arrangements of the recording system 100 and the recording system unit conveying system 200. In the arrangement of FIG. 16, in addition to the arrangement of FIG. 14, a regulating member 216 having an elongated hole 216A extends from the carriage 201 to the carriage 203, and a pin 217 extends on the carriage 203. The pin 217 is engaged with the elongated hole 216A. Therefore, the carriage 203 can be moved relative to the carriage 201 within the range defined by the length of the elongated hole.

In the arrangement of FIG. 17, in addition to the arrangement of FIG. 14, the carriage 201 is connected to the carriage 203 through a wire 218. Both the carriages cannot be spaced apart from each other by a distance exceeding the length of the wire 218.

In the arrangement of FIG. 18, in addition to the arrangement of FIG. 14, a recess 220 having a predetermined length is formed at a portion of the carriage 201 near the wire 209B. A stop wheel 219 is fixed to the predetermined position of the wire 209B so as to correspond to the recess 220. The stop wheel 219 is engaged with the recess 220. Therefore, the carriage 203 is moved relative to the carriage 201 by a distance corresponding to the range in which the stop wheel 219 is moved within the recess 220.

According to the above three arrangements, slippage between the wire pulleys, motor error accumulation, motor failure, and disconnections of the supply pipe 103 upon movement of one carriage during maintenance do not occur.

It is effective to control position correction of both the carriages as in the arrangement of FIG. 14. In addition, in the arrangement of FIG. 17, even if both the carriages collide against each other or the wire 218 is kept taut, its impact does not cause degradation of the printing quality. In the arrangements of FIGS. 15 and 18, even if the pin 217 abuts against the end of the elongated hole 218B or the stop wheel 219 collides against the side wall of the recess 220 in an extreme case, this impact force does not degrade recording quality.

In the arrangement of FIG. 15, both the carriages may be connected by a wire or the like. This can be effectively controlled by this embodiment.

Recording Medium Conveying System

As has been described with reference to FIG. 2, the recording medium PP conveyed through the conveying path PC, PR, or PI is exhausted from the lower conveying rollers 331 to the upper conveying rollers 341 through the platen 401. Holding (to be referred to as "setting" hereinafter) of the recording medium PP in the recording apparatus (recording position) is achieved by clamping of the leading end of the recording medium between the upper conveying rollers 341A and 341B. Recording of the recording medium PP on the platen 401 is started with the recording head 101. The biasing rollers 331B and 341B are urged against the main rollers 331A and 341A by biasing springs. A biasing spring 350 biases the biasing roller 341B against the main roller 341A (FIG. 12).

Figure 19:
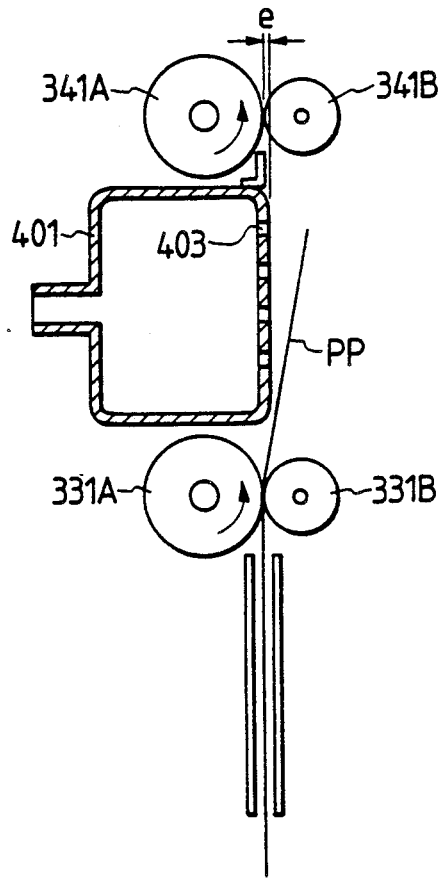
FIG. 19 is a view for explaining the conveying state of the recording medium when the guide member according to the present invention is not used.

As shown in FIG. 19, the recording medium having passed between the conveying rollers 331A and 331B abuts against the lower edge of the platen 401 and biasing roller 341B or is deviated from the conveying path due to its weight.

Figure 20:
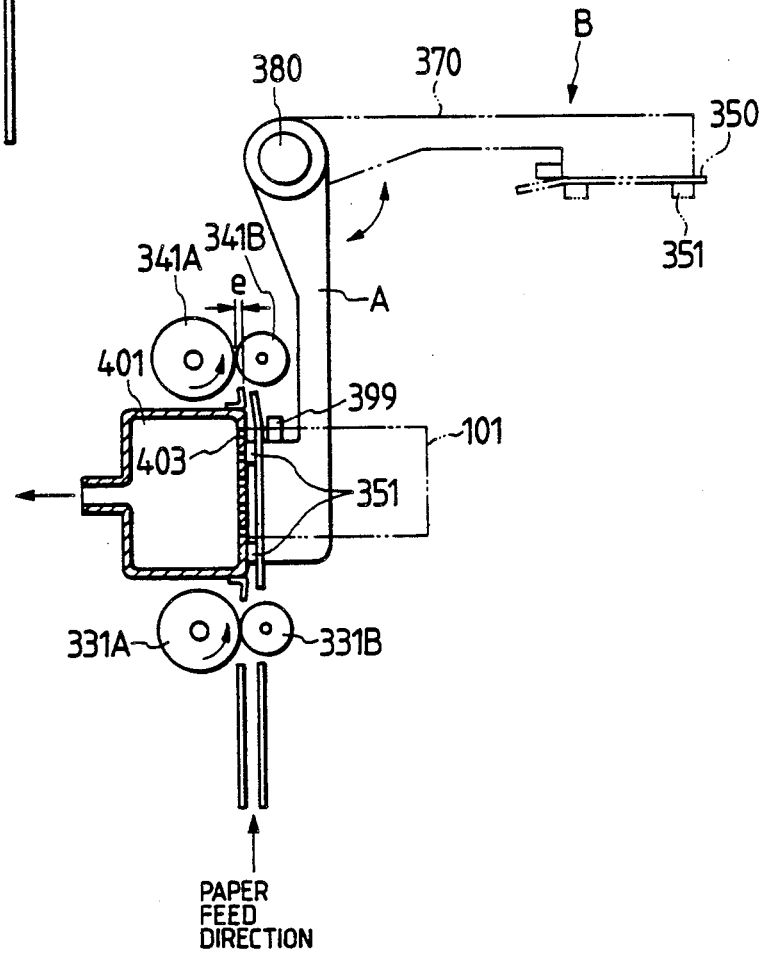
FIG. 20 is a schematic side view showing an arrangement of a guide member according to the present invention.

A schematic arrangement of a guide for smoothly setting the recording medium PP will be described with reference to FIG. 20. A guide member 350 guides between the upper convey rollers 341 the leading end of the recording medium PP rotatably supported by the arm 370 about the rotating shaft 380. At the time of setting of the recording medium PP, the recording head 101 is located at a position excluded from the recording area (e.g., home position)., At the same time, the guide member 350 is located at the setting position A, thereby achieving smooth setting. At the time of recording, the guide member 350 is located at a retracted position B so as to prevent interference of scanning of the recording head 101. When the front surface (the suction surface of the recording medium PP which corresponds to the suction hole 403) of the platen 401 is shifted by a predetermined amount e from the clamping positions of the upper and lower conveying rollers, the recording medium PP can be conveyed while the upper and lower edges of the front surface of the platen 401 are kept regulated. Fine wrinkles can be removed in consideration of the restoration force (so-called "nerve") of the recording medium PP.

Abutment units 351 (to be described in detail later with reference to FIGS. 27 and 28) are formed at guide portions opposite to the front surface of the platen 401 outside the conveying path of the recording medium PP. The abutment units 351 are used to maintain a distance between the guide member 350 and the platen 401 to be a predetermined value. A paper passing sensor 399 is integrally formed with the guide member 350 and is used to detect passing of the recording medium PP.

Figure 21A:
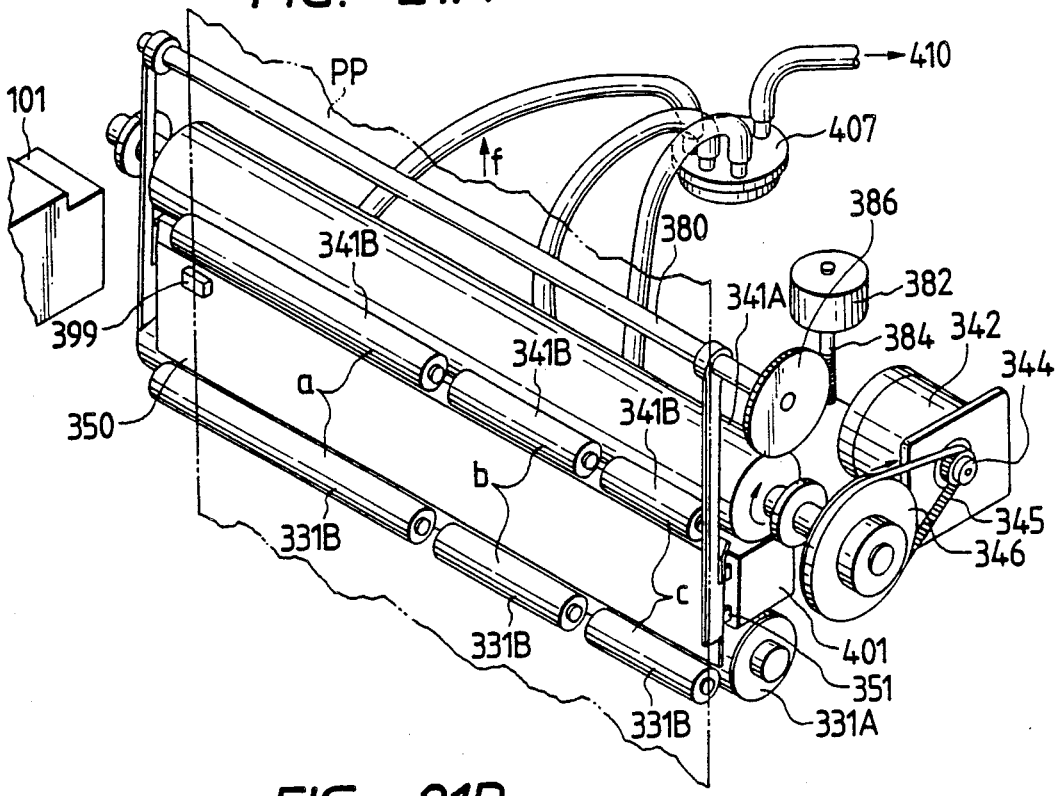
FIGS. 21A and 21B are perspective views showing states wherein the guide member shown in FIG. 20 is set in the recording medium set position and the retracted position, respectively.
Figure 21B:
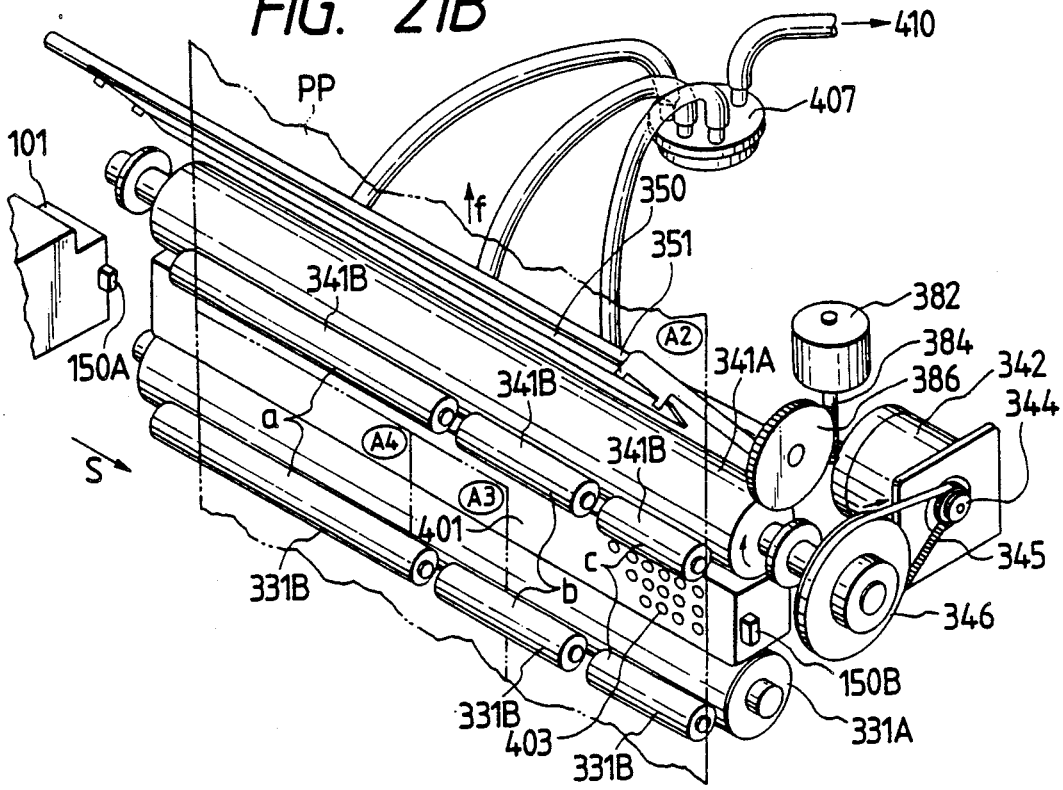

FIGS. 21A and 21B show an arrangement of the main part of the recording medium conveying system. FIG. 21A shows a state wherein the paper guide member 350 is located at the set position A, and FIG. 21B shows a state wherein the guide member 350 is located at the retracted position B.

Referring to FIGS. 21A and 21B, a conveying motor 342 comprises a pulse motor. A pulley 344 is fixed on the shaft of the conveying motor 342. A pulley 346 is fixed on the shaft of the main roller 341A of the upper conveying rollers. A belt 345 is looped between the pulleys 344 and 346 to transmit a rotational force of the conveying motor 342 to the main roller 341A. A guide driving motor 382 drives the guide member 350 to the set position A or the retracted position B. The guide driving motor 382 drives the guide member 350 through a worm 384 mounted on the shaft thereof and a worm gear 386 fixed on a rotating shaft 380 and meshed with the worm 384.

With the above arrangement, the guide member 350 is set to oppose the platen 401 during setting of the recording medium PP, as shown in FIG. 21A. In this state, the recording medium PP is conveyed in the f direction. The leading end of the recording medium PP is clamped between the main roller 331A and the biasing roller 331B of the lower conveying rollers 331 and is accurately guided while its conveying path is defined on the platen 401 by the guide member 350. The recording medium PP is clamped between the main roller 341A and the biasing roller 341B of the upper conveying rollers 341. When an abnormality occurs during this operation, it is detected by the paper passing sensor 399.

When the recording medium PP is set, i.e., the leading end of the recording medium PP is pinched between the upper conveying rollers 341, the guide driving motor 382 is driven to move the guide member 350 to the retracted position through the worm gear 386, as shown in FIG. 21B. In this state, the recording head 101 can be scanned in the S direction, thereby performing recording.

Referring to FIG. 21B, a pair of sensors 150A and 150B are fixed on a side surface of the recording head 101 along the scanning direction and a portion opposite thereto along the same direction. The mode of control including these sensors will be described in detail with reference to FIGS. 30A to 30D.

The recording medium PP can be smoothly set by using the guide member described above, as compared with a case without the guide member.

In this arrangement, in order to minimize the width of the conveying path of the front surface of the platen 401 during setting to prevent paper floating, the following arrangement is employed.

Figure 22:
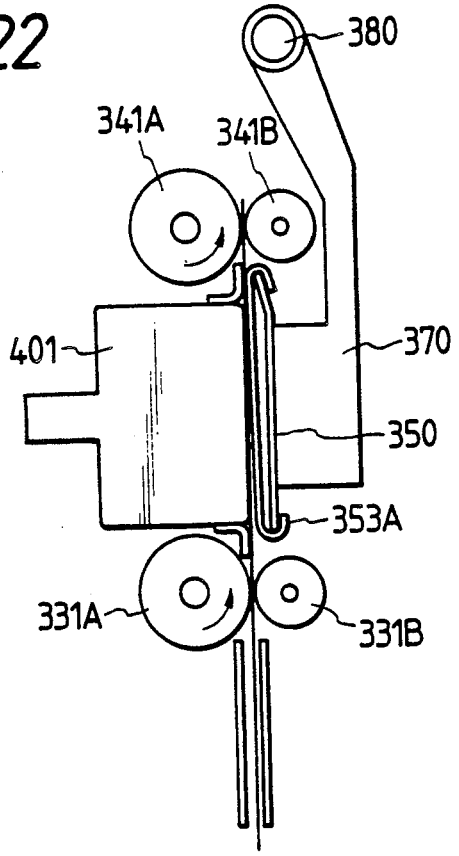
FIGS. 22 to 24 are side views respectively showing arrangements of a recording medium regulating member used in the guide member according to the present invention.
Figure 23:
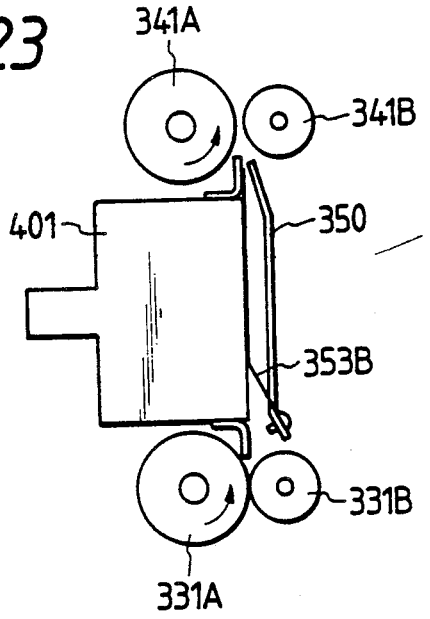

FIGS. 22 and 23 show floating preventive arrangements, respectively. Referring to FIGS. 22 and 23, a regulating member 353A (FIG. 22) consisting of Mylar or a regulating member 353B (FIG. 23) comprising a leaf spring is arranged at the entire or partial width of the guide member 350 which opposes the platen 401. When these members are set, the entire or partial width of the recording medium PP is urged against the front surface of the platen 401. The urging force is determined not to interfere with conveyance of the recording medium PP. Alternatively, the floating preventive member is disposed to be spaced apart from the front surface of the platen by a distance corresponding to the thickness (about 0.1 mm) of the recording medium PP, thereby achieving setting of the recording medium PP without floating.

Figure 24:
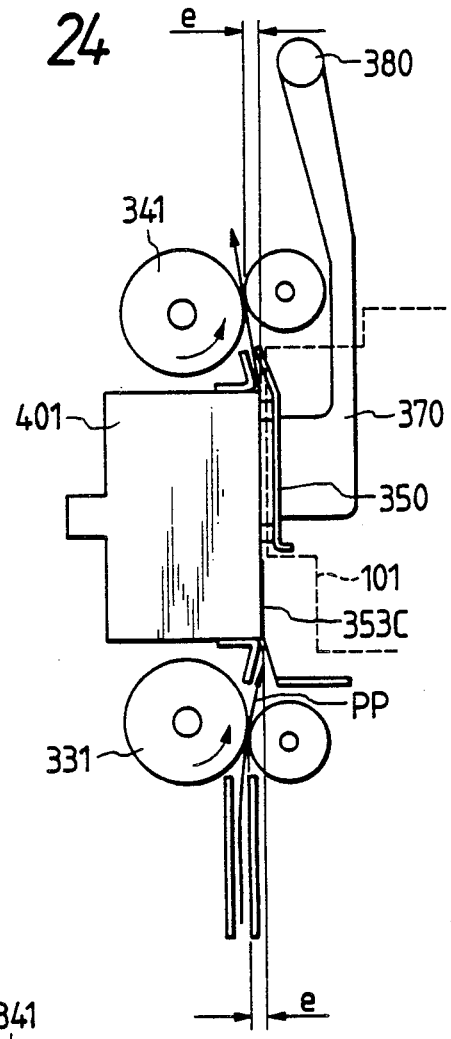

As shown in FIGS. 22 and 23, a regulating member 353C is not formed on the surface of the guide member 350, depending on the layout of the recording head 101. In this case, as shown in FIG. 24, a regulating member 353C may be formed below the guide member 350 so as to be spaced apart from the guide member 350. In this case, the regulating member 353C can be combined with the arm 370 to move the guide member 350 between the set position and the retracted position.

The biasing member 353C may be a member made of Mylar or a leaf spring. During setting of the recording medium, the biasing member is urged against the front surface of the platen 401, and the biasing force is determined so as not to interfere with conveyance of the recording medium PP. Alternatively, the biasing member is spaced apart from the platen by a distance corresponding to the thickness of the recording medium PP. Therefore, the recording medium PP can be set without being floated.

Each abutment unit 351 used in this embodiment will be described with reference to FIGS. 25 and 26.

Each abutment unit 351 sets a uniform distance between the guide member 350 and the platen 401 to allow smooth setting of the recording medium. In this arrangement, two abutment units are used at both sides of the platen 401 by utilizing the elastic force of the coil springs, thereby obtaining the uniform distance described above. Therefore, an impact force acting during setting of the recording medium to the set position can be damped.

Figure 25:
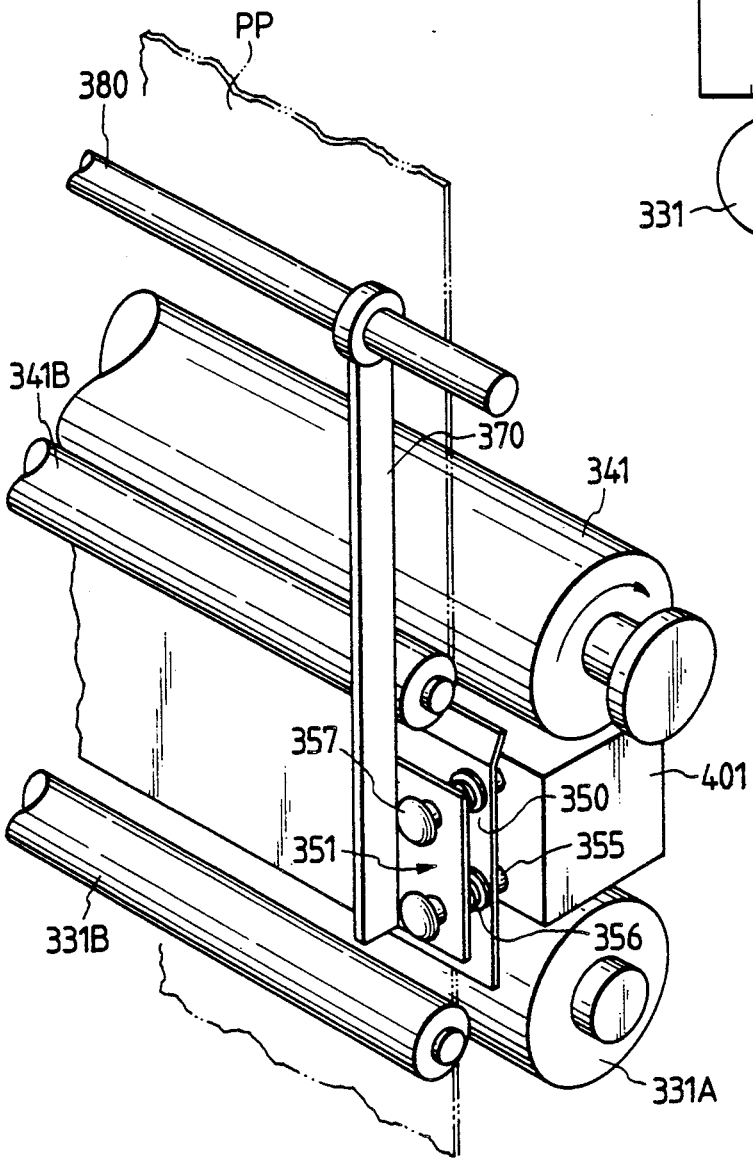
FIGS. 25 and 26 are a perspective view and a side view showing an arrangement of an abutment portion used in the guide member according to the present invention.
Figure 26:
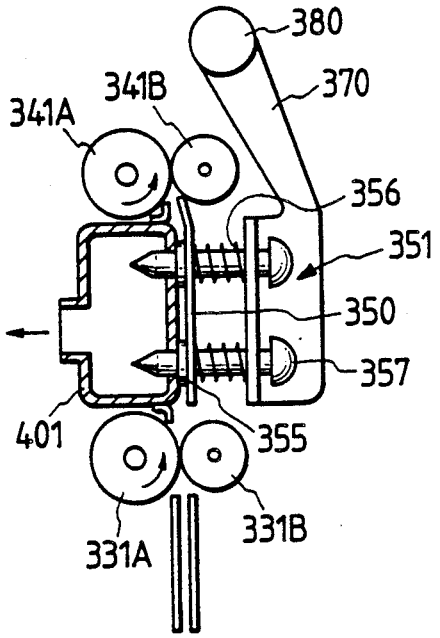

FIGS. 25 and 26 are a perspective view and a side view of the abutment unit 351 according to this embodiment. The abutment units 351 are respectively arranged at both sides of the platen 401.

Referring to FIGS. 25 and 26, each abutment unit 351 comprises a curved abutment plate 355 arranged at a contact portion with the platen outside the conveying path of the recording medium PP (actually the abutment plates of the abutment units 351 are arranged at both sides of the guide member 350), coil springs 356 for elastically supporting the arm 370 on the guide member 350, and positioning pins 357 respectively inserted into positioning holes formed in the platen 401 through the corresponding coil springs 356. In this embodiment, each positioning pin 357 is inserted in the curved abutment plate 355 through the corresponding coil spring 356 and serves as a holding member of the coil spring 356. However, this arrangement is not essential, and another arrangement may also be utilized to constitute the abutment unit.

With the arrangement of FIGS. 25 and 26, when the arm 370 is rotated to set the guide member 350 to the set position of the recording medium PP, the guide member 350 is displaced in accordance with the surface of the platen 401 regardless of the stop position or the like, thereby providing a uniform distance between the guide member 350 and the platen 401, and the impact force can be damped by the springs 356. If component precision of only the abutment plates 355 is maintained, manufacturing precision of other components and mounting precision may be slightly degraded, but the uniform distance can be assured. Therefore, the recording medium PP can be more smoothly set.

This arrangement is not limited to the flat platen 401 but can be efficiently utilized for a guide plate having the same radius of curvature as that of the cylindrical platen or a similar polygonal guide member.

Detection of floating of the recording medium PP (to be referred to as paper floating hereinafter) will be described below. In this embodiment, as shown in FIG. 21B, the pair of photosensors 150A and 150B are arranged on one side surface of the recording head 101 and the portion opposite thereto along the scanning direction, respectively. Even if paper floating occurs due to some cause, paper floating can be detected prior to recording, thereby preventing contamination of the recording medium, degradation of the recording quality, ink-jet errors of the recording head 101, and damage to the recording head 101.

Detection of paper floating by a predetermined amount or more can be performed as follows, in addition to detection of an arrangement of FIG. 21B.

Figure 27:
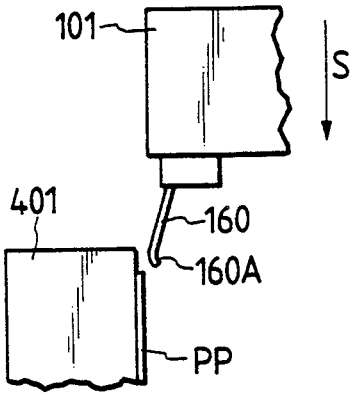
FIGS. 27 and 28 are views respectively illustrating arrangements of a paper floating detection sensor used in the present invention.
Figure 28:
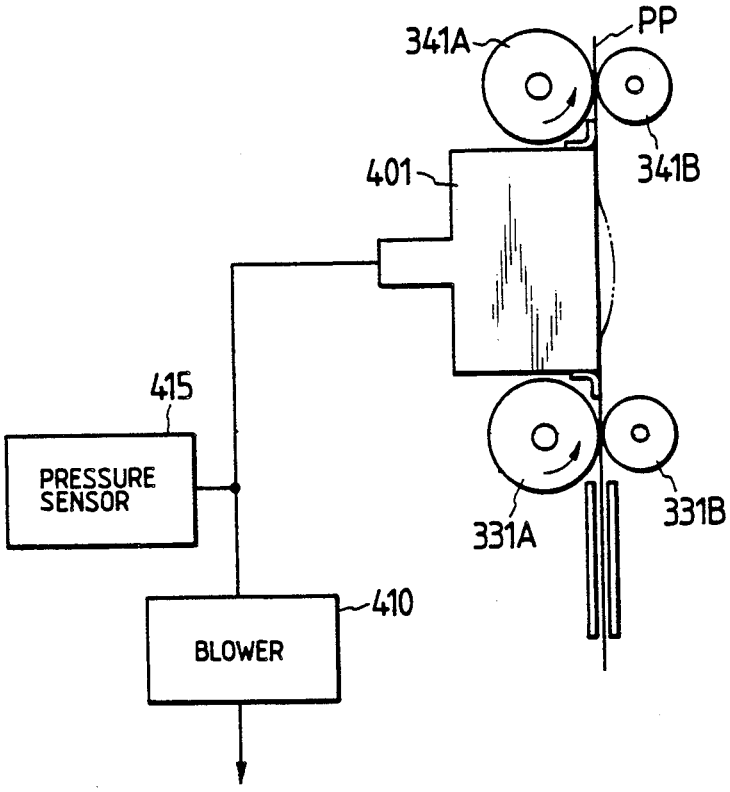

As shown in FIG. 27, a contact sensor 160 is arranged on the scanning-direction side surface of the recording head 101, as shown in FIG. 27. When paper floating occurs, an actuator 160A of the sensor 160 is brought into contact with the floating paper, thereby detecting paper floating. Alternatively, as shown in FIG. 28, when paper floating occurs, air is received in the platen 401 from the floating portion, and a suction force is changed. Therefore, a pressure sensor 415 may be arranged midway along the suction path to the blower 410, thereby monitoring paper floating. If paper floating occurs, a pressure during paper floating is compared with a pressure without paper floating, and detection of paper floating is performed.

Control System

Figure 29:
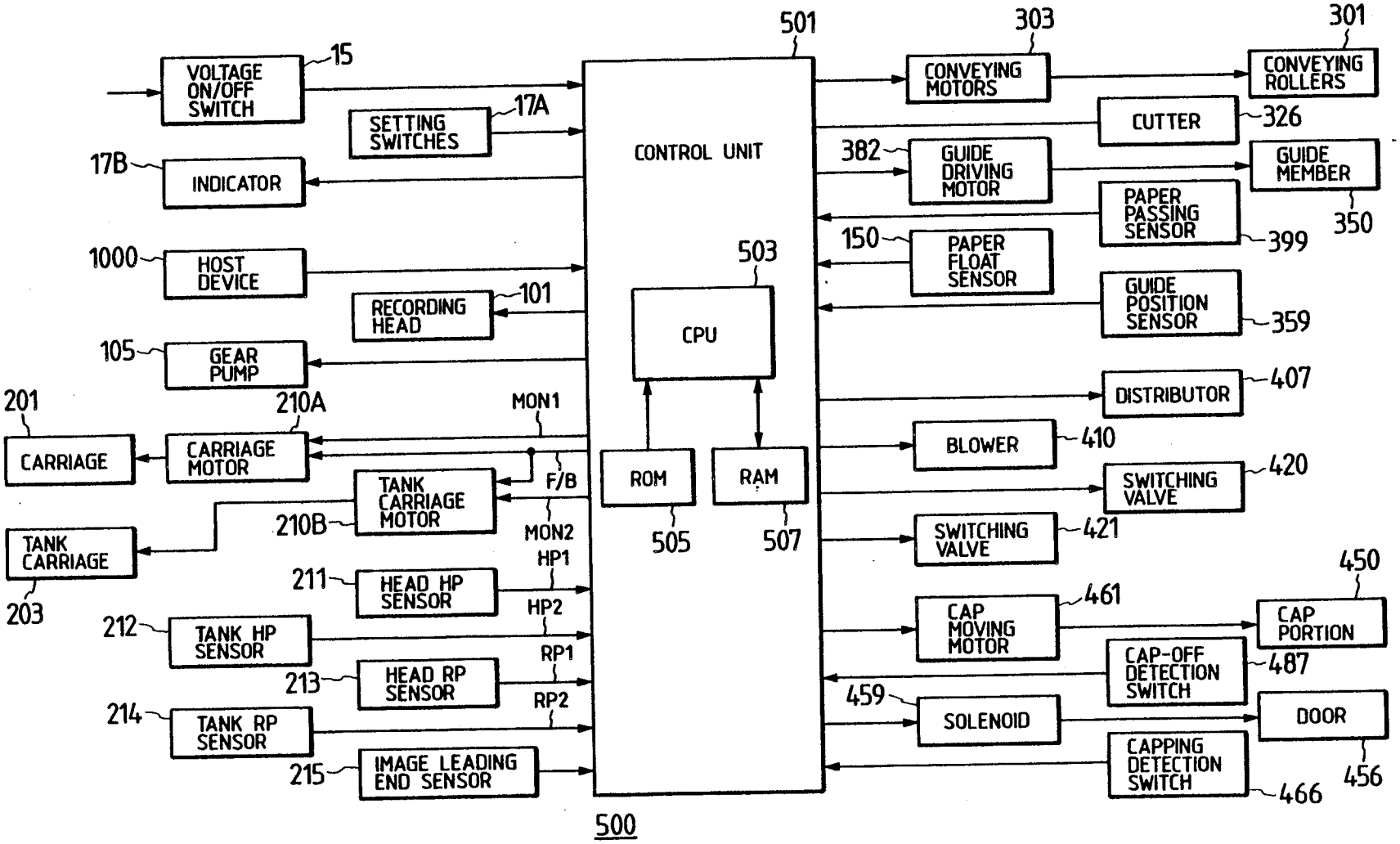
FIG. 29 is a block diagram showing a control system of the apparatus according to the present invention.

FIG. 29 shows an arrangement of the control system 500 according to this embodiment. A control unit 501 controls the operations of the respective components. The control unit 501 may be comprised of a central processing unit for processing recording data in accordance with data transmitted from the host device 1000 serving as the image data source to the ink-jet recording apparatus 1 according to this embodiment. The control unit 501 includes a CPU 503 in the form of a microcomputer serving as a main unit of the control unit 501 and controls the respective components in accordance with the control procedures shown in FIGS. 30A to 30D. The control unit 501 also includes a ROM 505 for storing programs corresponding to the processing procedures (FIGS. 30A to 30D) executed by the CPU 503 and other permanent data, and a RAM 507 having a working area used in execution of the procedures by the CPU 503 and areas in which a predetermined amount of image data is expanded.

Setting switches 17A are arranged in the operation panel 17 (FIG. 1) and include a size selection switch for selecting sizes of the recording medium PP, a selection switch for selecting the conveying paths PC, PR, and PI, a recording start command switch, and an on-line switch for allowing the apparatus to communicate with the host device 1000. The operation panel 17 also includes a display unit 17B including display elements for displaying a selected mode and various messages such as error messages.

Driving signals MON1 and MON2 drive the carriage motor 210A and the tank carriage motor 210B. Control signals F/B are supplied to rotate the carriage motor 210A and the carriage motor 210B in the forward or reverse directions so as to move the carriage 201 and the tank carriage 203 forward or backward in the scanning direction.

Conveying rollers 301 such as the upper conveying rollers 341 are arranged in the recording medium conveying system 300. Conveying motors 303 such as a motor 342 are used to drive the conveying rollers 301. A paper float sensor 150 consists of the pair of sensors 150A and 150B shown in FIG. 21B. The paper float sensor 150 may be the contact sensor 160 shown in FIG. 27 or the pressure sensor 415 shown in FIG. 28. Guide position sensors 359 are arranged at the set and retracted positions of the guide member 350. When a pulse motor is used as the guide driving motor 382, the position can be set by counting the driving pulses of the pulse motor in place of the sensor 359.

FIGS. 30A to 30D are flow charts for explaining control operations of the control unit 501 in FIG. 29.

Figure 30A:
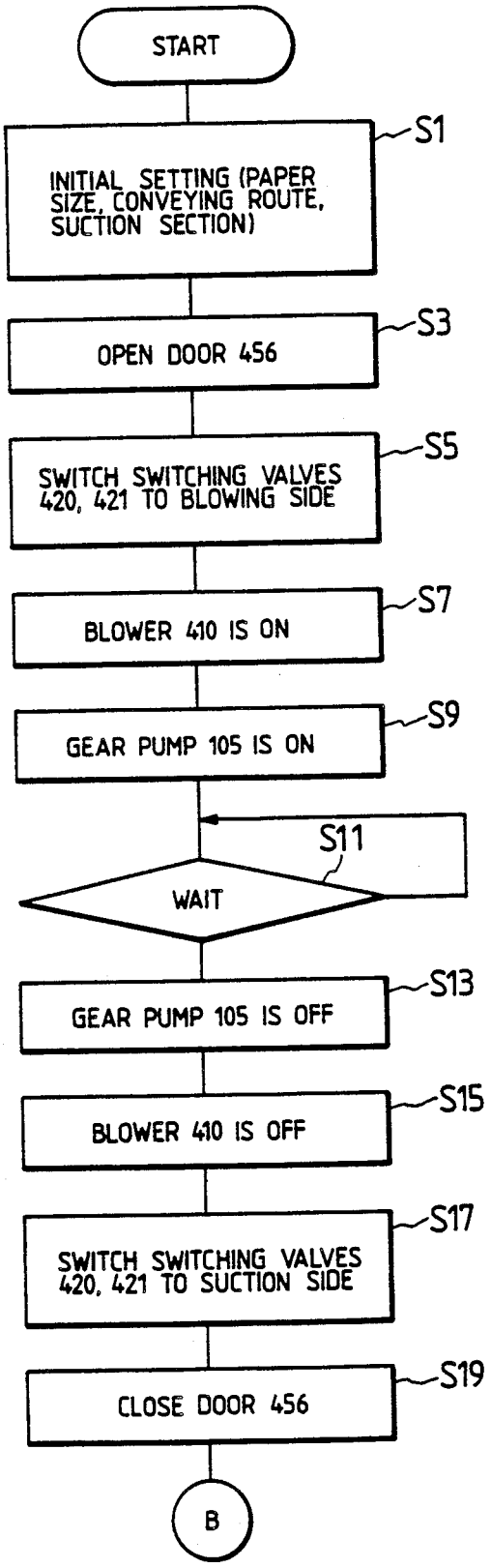
FIGS. 30A to 30D are flow charts for explaining the operations of the control system shown in FIG. 29.

When the voltage ON/OFF switch 15 is turned on and this program is initialized in response to a command from a command switch or the host device 1000, in step S1 of FIG. 30A, initialization is performed. During initialization, the distributor 407 is operated to select a suction zone (FIG. 10) in accordance with the size of the recording medium PP which is designated by the setting switches 17A or the host device 1000, and operations for control for driving the conveying members upon selection of the conveying path PC, PR, or PI are performed. In this case, the guide member 350 is located at the set position, and the recording head 101 is located at the home position. The door 456 is closed by the cap portion 450, and capping is being performed.

In step S3, the solenoid 459 is energized to open the door 456. In step S5, the switching valves 420 and 421 are set to the blowing side, i.e., in a mode wherein air is supplied from the blower 410 through the nozzle 451.

In this state, in step S9, the gear pump 105 is driven to compress the ink supply path to the recording head 101. The ink is forcibly exhausted from the recording head 101. When bubbles or dust are mixed in the ink chamber 101C or the nozzle 101B, or the viscosity of the ink is increased, discharge errors can be eliminated. The exhausted ink is collected by the absorbing member 453, and the discharge surface 101A is cleaned with a high-speed air jet from the nozzle 451. Compressing or cleaning operation continues within a predetermined period of time by the waiting procedure in step S11. In steps S13 and S15, the gear pump 105 and the blower 410 are turned off.

In step S17, the switching valves 420 and 421 are switched to the suction side, i.e., in a mode wherein suction is performed from the platen 401. In order to prepare for the subsequent recording operation, the door 456 is closed in step S19. In association with the compressing and cleaning operations in steps S7 to S15, all the discharge energy generating elements of the recording head 101 are driven to discharge the ink after the compressing and cleaning operations or instead of compression with the gear pump.

Figure 30B:
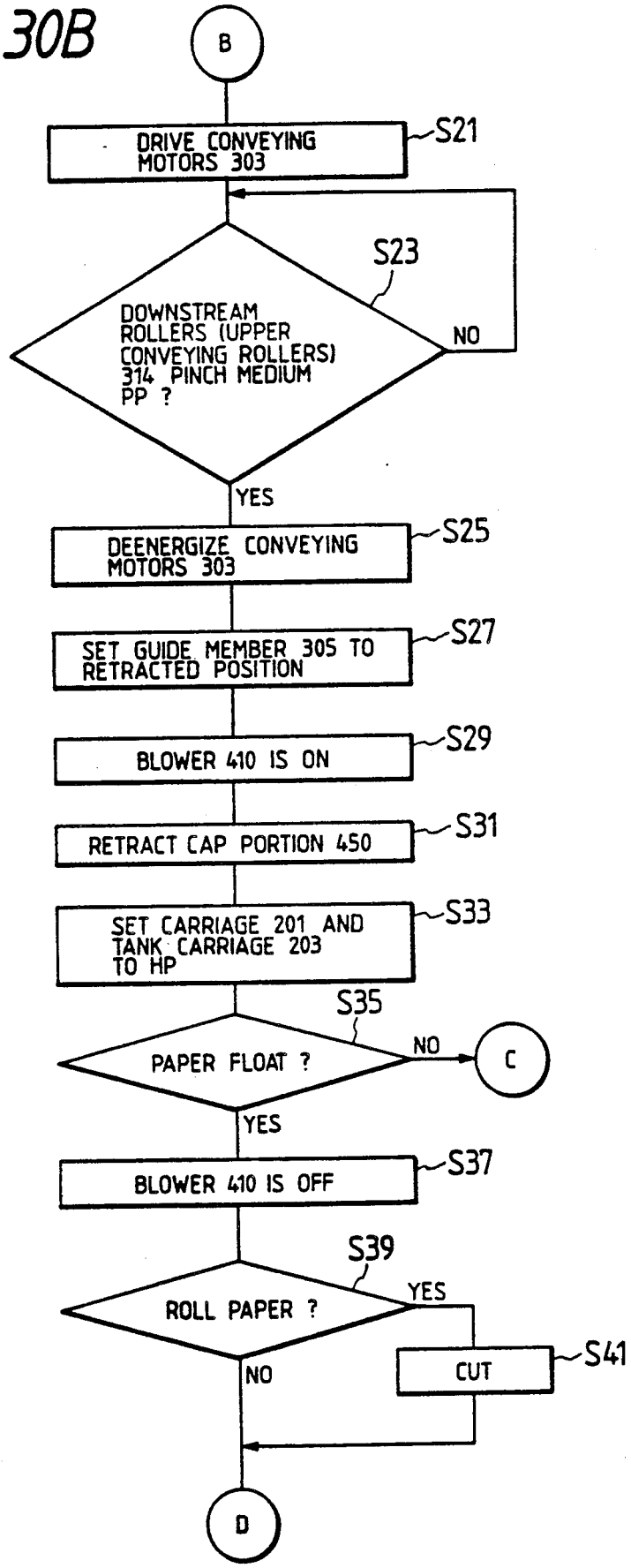
Figure 30C:
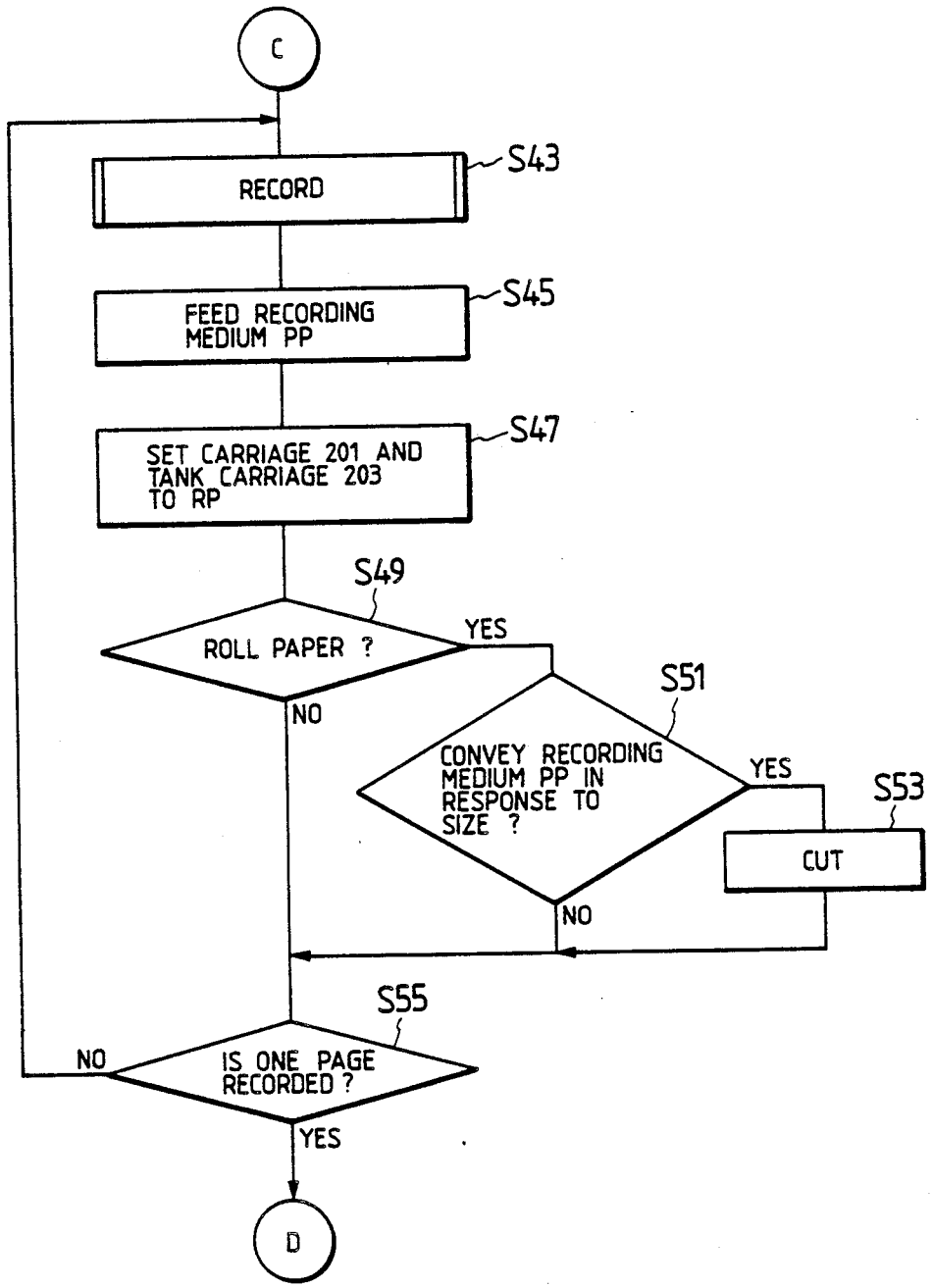
Figure 30D:
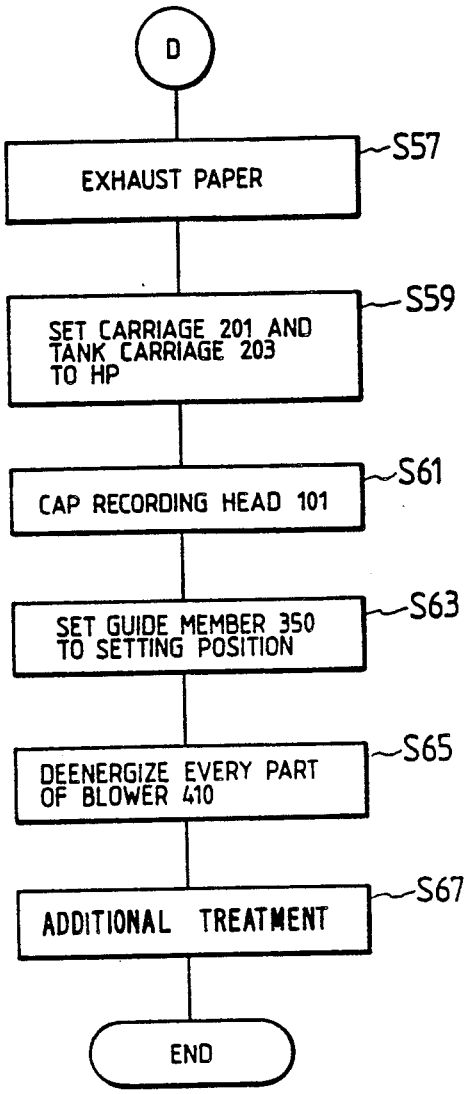

Referring to FIG. 30B in step S21, the motors 303 associated with conveyance are driven to start conveying the recording medium PP. Thereafter, in step S23, the CPU 503 determines whether the leading end of the conveyed recording medium PP is clamped by the upper conveying rollers 341 located on the downstream side of the platen 401. If YES in step S23, the motors 303 are stopped in step S25. In consideration of FIG. 23, the paper passing sensor 399 generates a detection output when a predetermined period of time has elapsed upon passing of the recording medium PP. Alternatively, a separate sensor may be arranged near the upper conveying rollers 341 to detect whether the leading end is clamped between the upper conveying rollers 341.

The leading end of the recording medium PP is smoothly conveyed between the rollers 331 to 341 by the guide member 351 and other regulating members (FIGS. 22 to 24). When a conveying error caused by a given cause or paper jam occurs prior to paper guiding, the paper passing sensor 399 does not output a detection signal. In this case, an error is displayed on the display unit 17B, thereby signaling the error to the operator.

After the operation in step S25 is completed the motor 382 is driven to set the guide member 350 at the retracted position in step S27. In step S29, the blower 410 is turned on to chuck the recording medium PP on the front surface of the platen 401. In step S31, the cap moving motor 461 is rotated in the reverse direction to separate the cap portion 450 from the recording head 101, thereby obtaining the cap-off position.

In step S33, the carriage 201 and the tank carriage 203 are accurately set at the home positions, thereby correcting the relative distance in the following manner. The motor driving signals MON1 and MON2 are output to perform the operation in FIG. 31 while the outputs (HP1 and HP2) from the home position (HP) sensors 211 and 212 are being monitored.

The presence or absence of paper floating is determined by using the sensor 150 in step 35. If YES in step S35, the flow advances to step S43 of FIG. 30C. However, if NO in step S35, recording is not performed. The blower 410 is turned off in step S37, and the CPU 503 determines in step S39 whether the recording medium PP is roll paper. If YES in step S39, the paper is cut by the cutter 326 in step S41. Otherwise, the recording medium is immediately exhausted by the exhausting processing in FIG. 30D.

In step S43, the motor 210A and the motor 210B are rotated in the forward direction to move the carriages 201 and 203 in the scanning direction. Recording by one unit, i.e., one scanning cycle in this embodiment is performed. If the exhaust port of the recording head 101 has a width of 16 mm in the subscanning direction, recording of 16 mm×1 scanning area is performed. During the recording operation, since the recording medium PP is kept attached to the platen 401, image recording with high quality can be performed. Thereafter, the motors 303 are driven in step S45 to convey the recording medium PP by a predetermined amount.

In step S47, the motors 210A and 210B are rotated in the reverse direction to set the carriage 201 and the tank carriage 203 at the reverse positions (RP), thereby correcting the distance therebetween in the following manner. The motor driving signals MON1 and MON2 are output while the outputs (PR1 and RP2) of the RP sensors 213 and 214 are being monitored.

Figure 31:
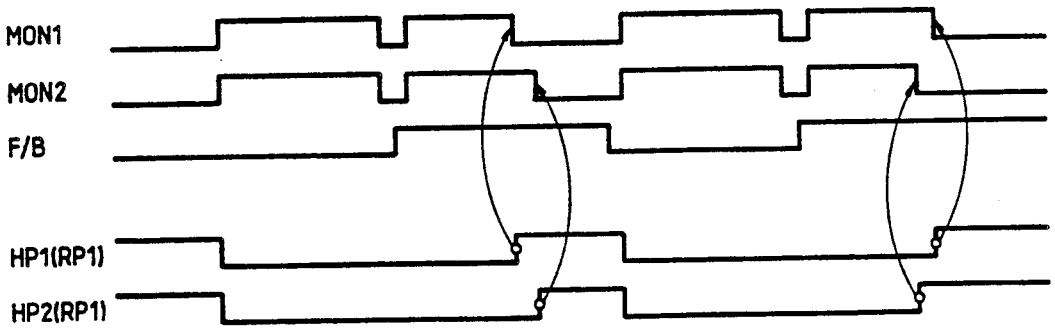
FIG. 31 is a timing chart for explaining timings for correcting the relative position between the carriage and the tank carriage according to the embodiment.

As shown in FIG. 31, during motor reverse operation (H level period of the F/B signal), the output RP1 from the RP sensor 213 is set at H level, and the carriage 201 is detected to reach the reverse position, the motor 210A is stopped. When the output from the RP sensor 214 is set at H level and the tank carriage 203 is detected to have reached the reverse position, the motor 210B is stopped. The distance between the carriages 201 and 203 is thus set to be optimum. Therefore, collision between both the carriages and a disconnection of the supply pipe 103 due to error accumulation do not occur.

The above correction can be performed for the HP sensors 211 and 212 by using the outputs HP1 and HP2. The correction operation may be performed every several scanning cycles instead of every scanning cycle. In addition, e.g, every plurality of scanning cycles capping of the head 101 is performed, and discharge recovery and cleaning by compression and discharge of the ink may be performed.

After the correction is performed, the CPU 503 determines in step S49 whether the currently used recording medium is roll paper. If NO in step S49, the flow immediately advances to step S55. However, if YES in step S49, the CPU 503 determines in step S51 whether paper feeding corresponding to the size of the recording medium PP and the recording amount is performed in consideration of the length from the position of the cutter 326 to the recording head 101. If NO in step S51, the flow advances to step S55. However, if YES in step S51, the roll paper is cut in step S53, and the flow advances to step S55.

The CPU 503 determines in step S55 whether recording is completed by a predetermined amount, i e., one page. If NO in step S55, the flow returns to step S43 and the above operations are repeated If YES in step S55, the flow advances to step S57 in FIG. 30D.

However, if NO in step S39, the operation in step S41 is completed, or YES in step S55, the motors 303 are controlled to exhaust the recording medium PP in step S57. In step S59, the carriage 201 and the tank carriages 203 are set at the home positions, and capping of the recording head 101 is performed in step S61.

The guide member 350 is located at the set position again in step S63, and the blower 410 and the like are stopped in step S65. The head 101 is capped with the door 456 being closed. Since the guide member is set at the set position, the head 101 can be protected after recording is completed, or the recording medium PP can be immediately set at the restart of recording. In step S67, all the additional treatments such as resetting of the respective components are performed, and this program is ended.

According to the embodiment described above, the following effects can be obtained.

Suction of the recording medium and air supply for cleaning the discharge surface 101A are performed by a single blower 410. The number of components can be reduced, and the compact, inexpensive, low-noise apparatus can be provided. The switching valves (421 and 420) are respectively arranged in a supply path from the blower 410 to the cap portion 450 and a suction path from the platen 401 to the blower 410, These switching valves are switched to supply air or draw air. For this reason, solved are the following problems such as discharge errors caused by an excessive amount of air flow supplied to the recording head 101, a decrease in suction force caused by a high load resistance when the nozzle 451 also serves as an exhaust port for suction, and a decrease in service life of the drive source upon repetition of ON/OFF operations when the suction and exhaust blowers are arranged.

During cleaning of the discharge surface 101A with air spraying, the door formed at the rear wall of the cap portion 450 can be opened, and the sprayed air flow is not disturbed. Small ink droplets and dust separated from the discharge surface 101A are not attached to the discharge surface 101A again. The cap portion 450 is selectively set between the capping position and the cap-off position. Position setting control for slightly separating the cap portion 450 from the head 101 to spray air can be eliminated.

The head 101 and the ink tank 110 are mounted on the different carriages (201 and 203) so as to assure positional precision and the like of the head 101 during recording. The head 101 and the ink tank 110 are driven by the corresponding motors (210A and 210B). The relative distance between the carriages is corrected every scanning cycle. Therefore, recording quality degradation by collision of the carriages upon slippage of the transmission members and error accumulation can be prevented. In addition, a disconnection of the supply pipe between the head and the tank by an excessively long distance between the carriages can be prevented.

The guide member 350 is arranged opposite to the platen 401 during setting of the recording medium PP so as to support smooth feed of the leading end of the recording medium PP. During recording, the guide member 350 is retracted to a position remote from the platen 401. Setting of the recording medium which is free from a conveying error such as paper jam can be performed regardless of the types (roll paper, cut paper, etc.) of the recording media PP even if the recording medium PP is warped. Since the guide member 350 is retracted after the setting of the recording medium is confirmed by the paper passing sensor 399 and the like, scanning by the recording head 101 is not interfered with.

Regulating member (353A to 353C) is arranged on the guide member 350 at a position opposite to the platen 401 to minimize the distance between the guide member 350 and the platen 401 so as to regulate the behavior of the leading end of the recording medium PP. The recording medium PP can be chucked to the platen 401 from the beginning of recording after suction of the recording medium PP and is properly regulated by the regulating member. The recording head 101 is not brought into contact with the recording medium PP. Contamination of the recording medium, the discharge errors of the recording head 101, and recording quality degradation by poor subscanning can be prevented.

In addition, at least three abutment members (four members in this embodiment) are formed on guide member 350 surface positions opposite to the peripheral portions of the platen 401 to elastically support the guide member 350. These abutment members are brought into contact with the platen 401. Therefore, when the guide member 350 opposes the platen 401, a uniform distance is assured therebetween in accordance with the surface shape of the platen 401. At the same time, high precision of the stop position of the guide member 350 and strict precision control of members excluding the abutment members need not be required.

The positions of the partition walls 405 (portions where the suction holes 403 are not present) of the platen 401 which partition the interior of the platen 401 are not aligned with the split positions of the biasing roller 341B split in accordance with the sizes of the recording media PP along the subscanning direction in accordance with the size of the recording medium PP. At least one of the biasing force of the roller and the suction force by the suction holes 403 of the platen 401 always acts on the recording medium PP. Therefore, even if the recording medium PP is swelled through recording, paper floating W does not occur in the recorded area. Therefore, contamination of the recording medium PP and the discharge errors of the recording head 101 can be prevented.

Since paper floating can be detected prior to scanning of the recording head 101, contamination of the recording medium PP and discharge errors of the recording head 101 can be prevented.

The present invention is not limited to the embodiment and arrangements described above, and various other changes and modifications may be made.

For example, air supply to the cap portion 450 aims at cleaning the discharge surface 101A of the recording head 101. However, this operation may be replaced with the following. That is, an air path is properly formed in the cap portion. More specifically, a flow path having a restrictor near the discharge port is formed, and the ink near the discharge port is removed by a venturi effect. Discharge recovery by compression using the gear pump 105 can be replaced with the above arrangement.

In the above embodiment, the recording medium in the form of continuous paper is a roll of paper RP. However, fanfold paper may be used. In the above embodiment, an apparatus is exemplified to record an image on a large recording medium having a size larger than A4. However, the size of the recording medium is not limited to the one mentioned above.

In the above embodiment, the recording medium PP can be fed in the vertical direction with respect to the recording head for discharging the ink in the horizontal direction. The discharging direction and the conveying direction of the recording medium can be arbitrarily determined. The arrangement of the platen is not limited to the flat platen as in the above embodiment, but can be extended to an arcuated platen.

In the above embodiment, the rollers (upper conveying rollers and the like) are used as the conveying members. However, for example, other members such as an endless belt looped around pulleys may be used to constitute a conveying member.

The present invention is not limited to the ink-jet recording apparatus of a serial type for causing the carriage 201 to move the recording head 101 so as to perform printing, as described above. The present invention is also applicable to a line printer whose discharge ports are aligned along the entire width of the recording medium. In this case, a mechanism for relatively moving the recording head and the platen to allow the cap portion to oppose the recording head during cleaning may be provided. Alternatively, at the time of setting of the recording medium PP, the guide member may be set to oppose the platen.

The present invention can be effectively and easily applied to a recording apparatus having other systems, e.g, a thermal head, in addition to the recording apparatus having a recording head of an ink-jet system as described above.

According to the embodiment described above, the guide member is arranged to oppose the platen during setting of the recording medium to smoothly guide the leading end of the recording medium. During recording, the guide member is separated from the platen to a remote position from the opposite position. Therefore, setting of the recording medium which is free from a conveying error such as paper jam can be performed regardless of the types (roll paper, cut paper, etc.) of recording media even if the recording medium is warped.

According to the present invention as has been described above, there is provided an image recording apparatus capable of recording an image whose quality can be improved.

What is claimed is:

1. An apparatus for recording an image on a recording medium, comprising:

a platen;

a recording head arranged to oppose said platen for recording the image on the recording medium;

first conveying means arranged upstream of said platen along a conveying direction of the recording medium for conveying the recording medium;

second conveying means arranged downstream of said platen along the conveying direction of the recording medium for conveying the recording medium;

guide means for guiding the recording medium when the recording medium is fed from said first conveying means to said second conveying means; and driving means for causing said guide means to set at an operative position where said guide means guides the recording medium and a retracted position where said guide means is retracted from the operative position.

2. An apparatus according to claim 1, wherein said recording head is reciprocable along said platen during recording.

3. An apparatus according to claim 1, wherein said recording head comprises an ink-jet head for injecting an ink solution.

4. An apparatus according to claim 1, wherein said platen comprises an air suction opening for drawing air therethrough.

5. An apparatus according to claim 1, wherein the operative position of said guide means is located between said first and second conveying means.

6. An apparatus according to claim 1, further comprising a sensor, arranged near the operative position of said guide means, for detecting passing of the recording medium.

7. An apparatus according to claim 1, further comprising a sensor for detecting passing of the recording medium, said guide means being retracted to the retracted position upon detection by said sensor.

8. An apparatus according to claim 1, wherein said guide means comprises a rotating shaft and a pivot arm pivotable about said rotating shaft.

9. An apparatus according to claim 1, wherein said platen defines a recording surface of the recording medium with respect to said recording head.

10. An apparatus for recording an image on a recording medium, comprising:

a platen;

a recording head arranged to oppose said platen for recording the image on the recording medium;

first conveying means, arranged upstream of said platen along a conveying direction of the recording medium, for conveying the recording medium;

second conveying means arranged downstream of said platen along the conveying direction of the recording medium for conveying the recording medium;

guide means for guiding the recording medium when the recording medium is fed from said first conveying means to said second conveying means;

driving means for causing said guide means to set at an operative position where said guide means guides the recording medium and a retracted position where said guide medium is retracted from the operative position; and regulating means arranged on said guide means for regulating a movement of the recording means.

11. An apparatus according to claim 10, wherein said regulating means comprises an elastic member, arranged to oppose said platen when said guide means is located at the operative position, for biasing the recording medium onto a surface of said platen with a force which does not interfere with feeding of the recording medium.

12. An apparatus according to claim 10, wherein said platen comprises a suction hole for chucking the recording medium on a contact surface with the recording medium.

13. An apparatus for recording an image on a recording medium, comprising:

a platen;

a recording head arranged to oppose said platen for recording the image on the recording medium;

first conveying means arranged upstream of said platen along a conveying direction of the recording medium for conveying the recording medium;

second conveying means, arranged downstream of said platen along the conveying direction of the recording medium for conveying the recording medium;

guide means for guiding the recording medium when the recording medium is fed from said first conveying means to said second conveying means;

driving means for causing said guide means to set at an operative position where said guide means guides the recording medium and a retracted position where said guide means is retracted from the operative position; and abutment means for regulating a distance between said guide means and said platen when said guide means is located at the operative position.

14. An apparatus according to claim 13, wherein said abutment means is arranged on said guide means and abuts against a peripheral portion of said platen to regulate the distance between said guide means and said platen.

15. An apparatus for recording an image on a recording medium, comprising:

a platen;

a recording head arranged to oppose said platen for recording the image on the recording medium;

first conveying means arranged upstream of said platen along a conveying direction of the recording medium for conveying the recording medium;

second conveying means arranged downstream of said platen along the conveying direction of the recording medium for conveying the recording medium;

guide means for guiding the recording medium when the recording medium is fed from said first conveying means to said second conveying means;

driving means for causing said guide means to set at an operative position where said guide means guides the recording medium and a retracted position where said guide means is retracted from the operative position;

detecting means for detecting floating of the recording medium by not less than a predetermined amount; and control means for inhibiting recording of said recording head when said detecting means detects the floating by not less than the predetermined amount.

16. An ink-jet recording apparatus comprising:

a recording head for discharging ink to perform recording;

first moving means which carries said recording head and movable along a scanning direction relative to a recording medium;

first driving means for driving said first moving means in the scanning direction;

ink storing means for storing said ink supplied to said recording head, said ink storing means being connected to said recording head through an ink supply pipe;

second moving means which carries said ink storing means and movable along the scanning direction;

second driving means, interlocked with said first driving means, for driving said second moving means in the scanning direction; and correcting means for controlling said first and second driving means to correct a distance between said first and second moving means within a predetermined value.

17. An apparatus according to claim 16, further comprising sensors located at home positions of said first and second moving means in the scanning direction or reverse positions during recording, wherein said correcting means monitors detection outputs from said sensors every scanning cycle or every plurality of scanning cycles and locates said first and second moving means at the home positions or the reverse positions, thereby correcting the distance to the predetermined value.

* * * * *

UNITED STATES PATENT AND TRADEMARK OFFICE

CERTIFICATE OF CORRECTION

PATENT NO. : 4,992,805

DATED : February 12, 1991

INVENTOR(S) : Yoshizawa et al.

It is certified that error appears in the above-identified patent and that said Letters Patent is hereby corrected as shown below:

COLUMN 3

Line 64, "through" (second occurrence) should be deleted.

COLUMN 4

Line 38, "sheet" should read --paper--.

COLUMN 10

Line 56, "sizes Suction" should read --sizes. Suction--.

COLUMN 11

Line 6, "platen 801" should read --platen 401--.

COLUMN 12

Line 5, "capping Reverse" should read --capping. Reverse--; and

Line 45, "designed" should read --designed.--.

UNITED STATES PATENT AND TRADEMARK OFFICE

CERTIFICATE OF CORRECTION

PATENT NO. : 4,992,805

DATED : February 12, 1991

INVENTOR(S) : Yoshizawa et al.

It is certified that error appears in the above-identified patent and that said Letters Patent is hereby corrected as shown below:

COLUMN 14

Line 35, "position).," should read --position).--.

COLUMN 19

Line 60, "cycles capping" should read --cycles, capping--.

COLUMN 20

Line 11, "repeated If" should read --repeated. If--.

COLUMN 23

Line 61, "recording means." should read --recording medium.--.

Signed and Sealed this

Twenty-fourth Day of November, 1992

*Attest:*

DOUGLAS B. COMER

*Attesting Officer*

*Acting Commissioner of Patents and Trademarks*